US005506782A

United States Patent [19]

Omae et al.

[11] Patent Number: 5,506,782

[45] Date of Patent: Apr. 9, 1996

[54] OPERATION MANAGEMENT SYSTEM FOR COKE OVEN

[75] Inventors: Yoshihiro Omae, Kitakyushu; Kunio Ishikawa, Tokyo; Yoshifumi Komatsu; Haruo Watanabe, both of Kitakyushu; Masaharu Someya, Tokyo; Michio Toyota, Kitakyushu; Shigenobu Takaki, Kitakyushu; Kiyohide Nyu, Kitakyushu; Shigeki Kataoda, Kitakyushu; Masaki Irie, Kitakyushu; Yoshio Yoshizumi, Yokkaichi; Satoru Kimura, Kitakyushu, all of Japan

[73] Assignee: Mitsubishi Chemical Corporation, Tokyo, Japan

[21] Appl. No.: 183,357

[22] Filed: Jan. 19, 1994

[30] Foreign Application Priority Data

| | | | |
|---|---|---|---|
| Jan. 20, 1993 | [JP] | Japan | 5-023524 |
| Jan. 20, 1993 | [JP] | Japan | 5-023525 |
| Jan. 20, 1993 | [JP] | Japan | 5-023526 |
| Jan. 20, 1993 | [JP] | Japan | 5-023527 |
| Jan. 20, 1993 | [JP] | Japan | 5-023528 |

[51] Int. Cl.[6] ..... G06F 17/00

[52] U.S. Cl. ..... 364/468

[58] Field of Search ..... 364/468–473, 364/496–503; 201/1, 41; 202/151, 248; 436/55; 44/620, 626; 75/317, 320, 325; 148/236

[56] References Cited

U.S. PATENT DOCUMENTS

| | | | |
|---|---|---|---|
| 4,045,292 | 8/1977 | Matsushita | 201/1 |
| 4,617,638 | 10/1986 | Krause et al. | 201/1 |
| 4,655,878 | 4/1987 | Yoshino et al. | 201/1 |
| 4,692,216 | 9/1987 | Polansky et al. | 201/1 |
| 5,033,004 | 7/1991 | Vandivier, III | 364/468 |
| 5,283,745 | 2/1994 | Tanahn | 364/468 |
| 5,299,115 | 3/1994 | Fields et al. | 364/468 |
| 5,315,509 | 5/1994 | Natarajan | 364/468 |
| 5,325,304 | 6/1994 | Aoki | 364/468 |

*Primary Examiner*—James P. Trammell

*Attorney, Agent, or Firm*—Oblon, Spivak, McClelland, Maier & Neustadt

[57] ABSTRACT

A coke oven operation management system capable of accomplishing unified management of an operation from receiving of stock coal to production and shipment of coke through management and control processing using a computer. A head office and branch offices of a concern determine basic schedules for production and shipment of coke and receiving of stock coal based on sale and self-consumption depending on a user's demand for coke and incoming information on coal from a colliery for every month and notify a production adjustment and management section of a coke production factory of the basic schedules, request the section of shipment of coke based on the user's demand, and instruct the section to receive coal.

6 Claims, 26 Drawing Sheets

FIG.6A

SHIPMENT SCHEDULE

TAKING-IN OF ESTIMATED SALE (EVERY THIRD OF MONTH)

(t)

| BRAND | SIZE | CUSTOMER | N+2 | | | N+3 | | |
|---|---|---|---|---|---|---|---|---|
| | | | FIRST | MIDDLE | LAST | FIRST | MIDDLE | LAST |
| A | | | | | | | | |
| B | | | | | | | | |

STORED COKE QUANTITY

SETTING OF RESIDUE AT END OF MONTH (N+1)

SETTING OF RESIDUE AT END OF EACH THIRD OF MONTH (t)

| BRAND | SIZE | RESIDUE ON MONTH (N+1) | RESIDUE ON MONTH (N+2) | | | RESIDUE ON MONTH (N+3) | | |
|---|---|---|---|---|---|---|---|---|
| | | | FIRST | MIDDLE | LAST | FIRST | MIDDLE | LAST |
| A | | | | | | | | |
| B | | | | | | | | |

PRODUCTION SCHEDULE

SETTING OF NUMBER OF OPERATIONS OF EACH OVEN GROUP

CALCULATION OF PRODUCTION REQUIRED (NUMBER OF TIMES OF OPERATION)

| OVEN GROUP | RESIDUE ON MONTH (N+2) | | | RESIDUE ON MONTH (N+3) | | |
|---|---|---|---|---|---|---|
| | FIRST | MIDDLE | LAST | FIRST | MIDDLE | LAST |
| 2 | | | | | | |
| 4 | | | | | | |

YIELD (COKE t/OPERATION)

CALCULATION OF NUMBER OF PRODUCTION OPERATIONS (NUMBER OF TIMES OF OPERATION)

| OVEN GROUP | BRAND | SIZE | N+2 | | | N+2 | | |
|---|---|---|---|---|---|---|---|---|
| | | | FIRST | MIDDLE | LAST | FIRST | MIDDLE | LAST |
| 2 | A | | | | | | | |
| | B | | | | | | | |

FIG.6B

SETTING OF FORMULATION

| BRAND | COAL FORMULATION RATE (%) | | | | |
|---|---|---|---|---|---|
| | a | b | c | - - - - - - - - - | TOTAL |
| A | | | | - - - - - - - - - - | 100 |

CONSUMPTION SCHEDULE

CALCULATION OF COAL CONSUMPTION

STORED COAL QUANTITY

SETTING OF RESIDUE AT END OF MONTH(N+1)

SETTING OF RESIDUE AT EACH THIRD OF MONTH

| COAL | RESIDUE ON MONTH (N+1) | MONTH (N+2) | | | | | MONTH (N+3) | | | |
|---|---|---|---|---|---|---|---|---|---|---|
| | | FIRST THIRD | | | - - - | - - - | LAST THIRD | | | |
| | | RECEIV -ING | CONSUMP -TION | RESIDUE | | | RECEIV -ING | CONSUMP -TION | RESIDUE | |
| a | | | | | | | | | | |
| b | | | | | | | | | | |
| c | | | | | | | | | | |
| d | | | | | | | | | | |

RECEIVING SCHEDULE

TAKING-IN OF ANTICIPATED COAL RECEIVING

CALCULATION OF REQUIRED QUANTITY OF RECEIVING OF COAL

| ANTICIPATED RECEIVING | | COAL | SHIP | SUPPLIER | QUANTITY |
|---|---|---|---|---|---|
| MONTH (N+2) | FIRST | a | | | |
| | MIDDLE | b | | | |
| | | c | | | |
| | LAST | d | | | |

FIG.7 A

SETTING OF NUMBER OF TIMES OF OPERATION AT EACH THIRD OF MONTH FOR 2 OVEN GROUPS [MONTHS (N+2),(N+3)]

ALLOTMENT OF NUMBER OF TIMES OF PRODUCTION

1) IMMEDIATE SHIPMENT BY VESSEL (STORED COKE=0)

i) CALCULATION OF PRODUCTION AT EACH THIRD OF MONTH (A QUANTITY OF SHIPMENT AT EACH THIRD-AI-QUANTITY OF PRODUCTION OF EACH OVEN GROUP AT EVERY THIRD)

YIELD (COKE t/PRODUCTION)

CALCULATION AND ALLOTMENT OF NUMBER OF TIMES OF PRODUCTION

| (N+2) | (N+3) | (NUMBER OF TIMES OF OPERATION) |
|---|---|---|
| FIRST | MIDDLE | LAST |
| 1250 | 1250 | 1350 |
| A,280 | A,290 | A,310 |

ii) TAKING-IN OF SHIPMENT OF OTHER BRANDS

YIELD (COKE t/PRODUCTION)

CALCULATION AND ALLOTMENT OF NUMBER OF TIMES OF PRODUCTION

| (N+2) | (N+3) | (NUMBER OF TIMES OF OPERATION) |
|---|---|---|
| FIRST | MIDDLE | LAST |
| 1250 | 1250 | 1350 |
| A,280 | A,290 | A,310 |
| B,290 | C,95 | D,50 |

FIG.8A

SETTING OF NUMBER OF TIMES OF OPERATION FOR 2 OVEN GROUPS ← OVEN OPERATION SCHEDULE (DETERMINATION OF OPERATION RATE, WORK SCHEDULE)

ALLOTMENT OF NUMBER OF TIMES OF PRODUCTION

1) IMMEDIATE SHIPMENT BY VESSEL (STORED COKE=0)

i) A. CALCULATION OF REQUIRED PRODUCTION (=A. SHIPMENT QUANTITY-AI. PRODUCTION OF OVEN GROUP)

YIELD (COKE t/PRODUCTION)

CALCULATION OF NUMBER OF TIMES OF PRODUCTION

ALLOTMENT OF PRODUCTION LOT (CONSIDERATION OF DEPARTURE TIME)

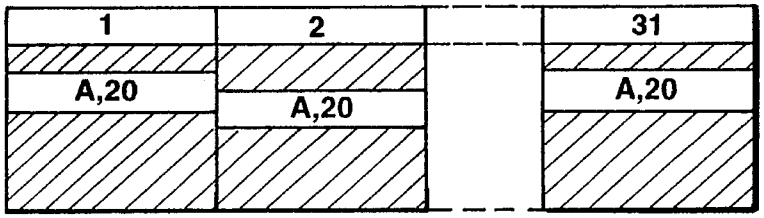

ii) TAKING-IN OF SHIPMENT OF OTHER BRANDS (=PRODUCTION)

YIELD (COKE t/PRODUCTION)

CALCULATION AND ALLOTMENT OF NUMBER OF TIMES OF PRODUCTION (CONSIDERATION OF DEPARTURE TIME)

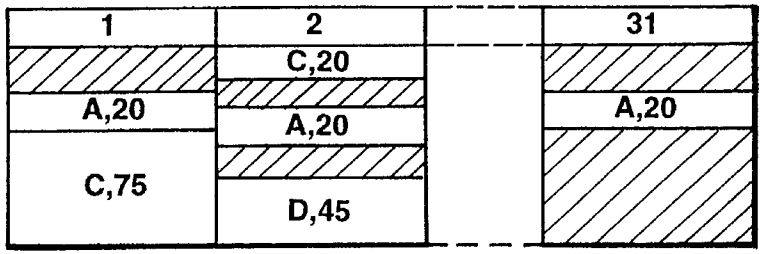

FIG.8B

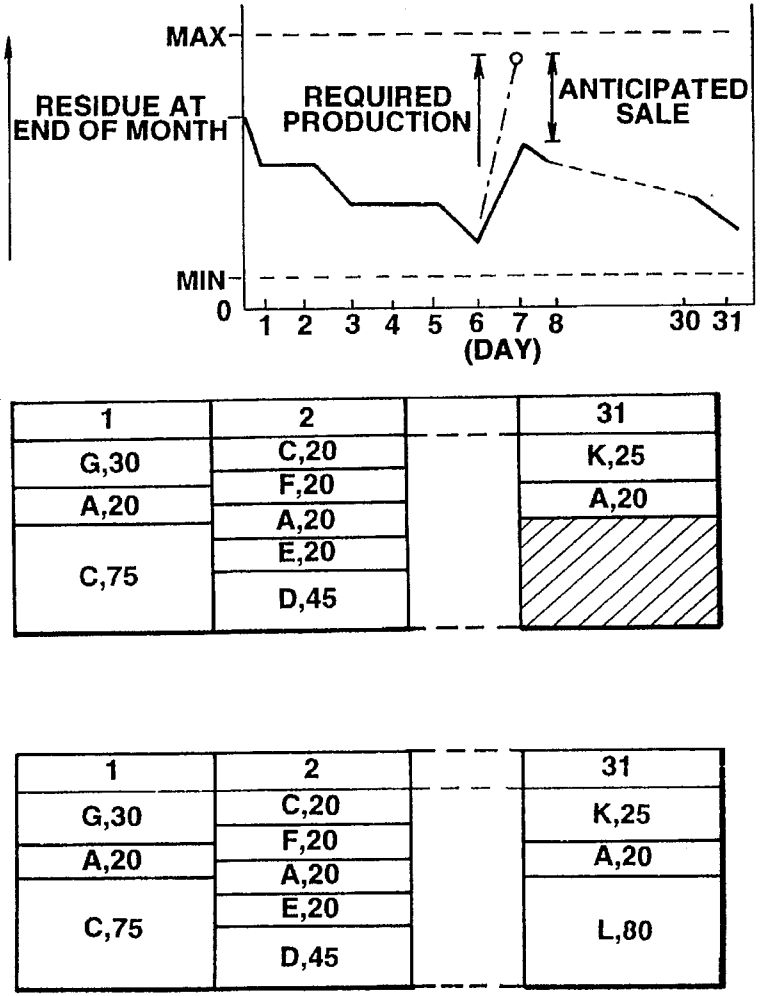

2) SHIPMENT BY TRUCK (STORED COKE)

STORED COKE

ESTIMATE OF RESIDUE AT END OF MONTH (N)

SETTING OF MAXIMUM AND MINIMUM

CALCULATION OF REQUIRED PRODUCTION AND PRODUCTION DATE

YIELD (COKE t/PRODUCTION)

CALCULATION AND ALLOTMENT OF NUMBER OF TIMES OF PRODUCTION

3) SHIPMENT BY VESSEL (STORED COKE FOR EXPORTATION)

CALCULATION OF NUMBER OF TIMES OF SURPLUS PRODUCTION

TAKING-IN OF BRAND PRODUCED

ALLOTMENT OF NUMBER OF TIMES OF PRODUCTION

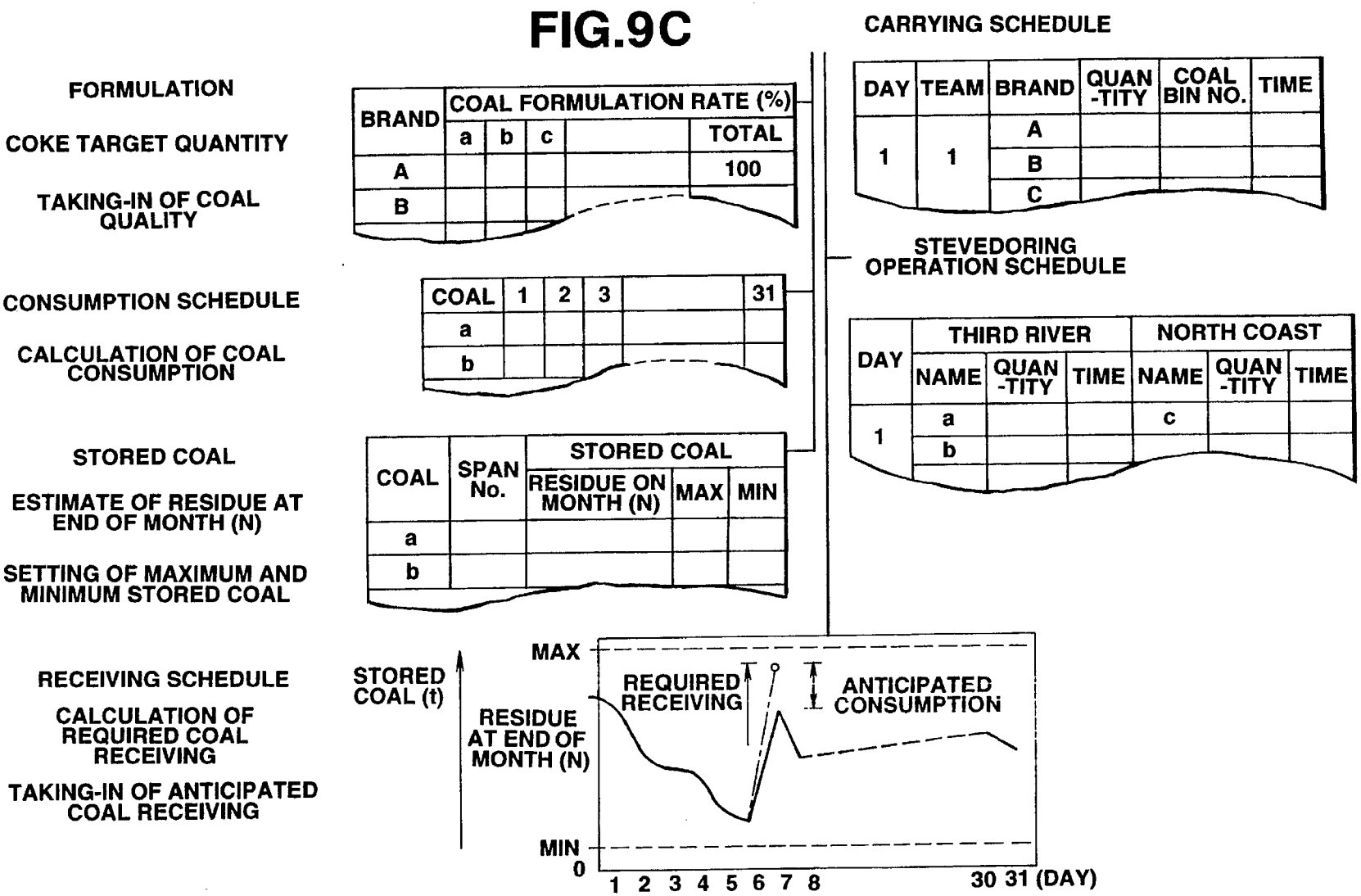
FIG.9C
CARRYING SCHEDULE
DAY
TEAM
BRAND
QUAN -TITY
COAL BIN NO.
TIME
1
1
A
B
C
STEVEDORING OPERATION SCHEDULE
DAY
THIRD RIVER
NORTH COAST
NAME
QUAN -TITY
TIME
NAME
QUAN -TITY
TIME
1
a
b
c
BRAND
COAL FORMULATION RATE (%)
a
b
c
TOTAL
A
B
100
COAL
1
2
3
31
a
b
COAL
SPAN No.
STORED COAL
RESIDUE ON MONTH (N)
MAX
MIN
a
b
MAX
MIN
STORED COAL (t)
RESIDUE AT END OF MONTH (N)
REQUIRED RECEIVING
ANTICIPATED CONSUMPTION
0
1 2 3 4 5 6 7 8
30 31 (DAY)
FORMULATION
COKE TARGET QUANTITY
TAKING-IN OF COAL QUALITY
CONSUMPTION SCHEDULE
CALCULATION OF COAL CONSUMPTION
STORED COAL
ESTIMATE OF RESIDUE AT END OF MONTH (N)
SETTING OF MAXIMUM AND MINIMUM STORED COAL
RECEIVING SCHEDULE
CALCULATION OF REQUIRED COAL RECEIVING
TAKING-IN OF ANTICIPATED COAL RECEIVING

OPERATION MANAGEMENT SYSTEM FOR COKE OVEN

BACKGROUND OF THE INVENTION

This invention relates to an operation management system for a coke oven, and more particularly to an operation management system for a coke oven which is adapted to carry out management of an operation of a coke oven from receiving of stock coal to production and shipment of a coke product.

Also, the present invention relates to a coal formulation accuracy management system in coke oven operation management, and more particularly to a coal formulation accuracy management system in an operation management system for a coke oven which, when stock coal of each brand pulverized into a predetermined particle size is formulated prior to carbonization of the coal in a coke oven, is adapted to appropriately manage formulation accuracy of the pulverized stock coal for the purpose of producing a coke product such as coke for iron-making, foundry coke, general-purpose coke or the like.

Further, the present invention relates to a coal particle size management system in operation management of a coke oven, and more particularly to a coal particle size management system in an operation management system for a coke oven which, when stock coal of each brand is pulverized into a predetermined particle size, is adapted to appropriately manage a particle size of the pulverized stock coal for the purpose of producing a coke product such as coke for iron-making, foundry coke, general-purpose coke or the like.

Furthermore, the present invention relates to a coke particle size management system in production of a coke product, and more particularly to a coke particle size management system which is adapted to carry out, for every lot, pulverization and grading of carbonized coke which was subject to carbonization in coke oven facilities and quenching in quenching facilities, to thereby produce a coke product, particularly, a general-purpose coke product.

In general, in a concern of production, sale and self-consumption of a coke product and a coke-based product, such a business management system as shown in FIGS. 13A and 13B is conventionally employed for production of coke and operation of a coke oven.

More particularly, a head office 1011 and branch offices 1011*a* of the concern make a shipment request 1041 to a business section 1013 of a coke production factory 1012 based on sales and self-consumption information 1102, 1102*a* depending on a demand of a user 1101 for coke and give the business section 1013 instructions on receiving 1042 of stock coal based on incoming information 1112 of stock coal from a colliery 1111 which is obtained on a side of the head office 1011.

Then, the head office 1011, branch offices 1011*a* and business section 1013 cooperate with each other to hold a coke production meeting 1031 and stock coal meeting 1032 about one time a month to determine an outline of each of a monthly coke production schedule 1033 and a monthly coal receiving schedule 1034 based on the coke production schedule 1033 to forward an outline of each of the monthly coke production schedule 1033 and monthly coal receiving schedule 1034 to a production adjustment and management group 1014*a* of a production section 1014 of the coke production factory 1012 together with necessary instructions.

The production adjustment and management group 1014*a* of the production section 1014 prepares a detailed daily coke production schedule 1035 concerning operation of a coke oven based on the monthly coke production schedule 1033 and monthly coal receiving schedule 1034 with reference to a stored coke quantity 1041*a* at that time. Concurrently, the production adjustment and management group 1041*a* prepares a detailed daily coal formulation schedule 1036 based on stock coal received and a stored coal quantity 1042*a* at that time in view of factors such as quality of stock coal, quality of coke, carbonization conditions and the like. Then, the production adjustment and management group 1014*a* gives daily product shipment instructions 1051 to a first product production group 1014$b_1$ based on the daily coke production schedule 1035 and gives daily coal formulation instructions 1052 through a first coal pulverization and formulation group 1014$c_1$ to a second coal pulverization and formulation group 1014$c_2$ based on the daily coal formulation schedule 1032*a*.

The first product production group 1014$b_1$ of the production section 1014 prepares a delivery schedule 1061 of the stored coke quantity 1041*a* according to the daily product shipment instructions 1051 and then prepares a running schedule 1071 for operation running of a coke oven including the delivery schedule 1061 to forward the schedule 1071 to the second product production group 1014$b_2$ together with required instructions. Also, the second coal pulverization and formulation group 1014$c_2$ prepares a running schedule 1072 for coal pulverization and formulation according to the daily coal formulation instructions 1052 from the production adjustment and management group 1014*a* to carry out a running operation 1082 for substantial pulverization and formulation of stock coal based on the coal pulverization and formulation running schedule 1072. Then, the second product production group 1014$b_2$ carries out a coke oven running operation 1081 for carbonizing the pulverized and formulated stock coal to produce coke.

In the conventional management system for production and shipment of coke described above, various kinds of stock coal received from the outside and stored in a coal yard is subject to a pulverization treatment and a formulation treatment in such a manner as shown in FIG. 14.

More particularly, each kind of stock coal 1202 stored in a coal yard 1201 is pulverized into a predetermined particle size by means of a coal pulverizer or a coal pulverization means 1211 such as an impeller breaker (IB) including pulverization blades of which a pulverization silt width is adjustably set on the basis of the coal formulation instructions 1052 for every brand including the daily coal pulverization instructions for every brand indicated in the daily formulation schedule 1036 for every brand and then sampled for every pulverization for particle size management. The stock coal thus pulverized into a predetermined particle size is carried in each of formulation tanks 1231 arranged separate from each other so as to form a formulation system for the purpose of formulation. Concurrently, water measurement data 1241 on coal for delivery are recorded. Also, the stock coal thus formulated is charged in each of coke ovens (not shown) through a coal bin (not shown) by means of a carrying system for carbonization.

In the conventional pulverized coal particle size management described above, for example, a variety of stock coal up to about sixty kinds is handled for coke production and coal for coke production is pulverized into particle diameters of 3 mm, 1.7 mm and 0.7 mm in view of a difference in brand of carbonized coke depending on applications thereof for iron-making, casting, general-purpose and the like.

Also, in the conventional management system for production and shipment, each kind of coal received from the outside and stored in a coal yard is pulverized and formulated in such a manner as shown in FIG. 15.

More particularly, stock coal 1202 stored in the coal yard 1201 is pulverized into a predetermined particle size by means of the coal pulverizer or the coal pulverization means 1211 such as an impeller breaker (IB) including pulverization blades of which a pulverization silt width is adjustably set on the basis of the coal formulation instructions 1052 for every brand including the daily coal pulverization instruction for every brand indicated by the daily coal formulation schedule 1036 for every brand and then suitably sampled by means of an automatic sampler 1211 for every pulverization for particle size management by a particle size measuring equipment 1222. Then, stock coal of each brand thus pulverized into a predetermined particle size is carried in each of the formulation tanks 1231 constituting the formulation system for formulation every time when the pulverization takes place. The stock coal formulated is charged in each of the coke ovens (not shown) through the coal bin tank (not shown) by means of the carrying system for carbonization.

During the above-described coal pulverization and formulation operation, results of particle size analysis **1222*a* by the particle size measuring equipment 1222 are used for preparing a particle size analysis table 1222*b* for stock coal of each brand. Also, formulated stock coal of each brand in the carrying system is subject to automatic water and particle size measurement 1231*a* commonly taking place in the art. Data obtained by the measurement 1231*a* are used for artificial judgment 1241*a*, so that the pulverization slit width of the pulverization blades of the impeller breaker 1211** is manually adjusted to keep a particle size of pulverized coal within a predetermined range.

More specifically, in a specified coke production factory, for example, a variety of stock coal up to about sixty kinds is handled for production of coal and coal for coke production is pulverized into particle diameters of 3 mm or more and below 3 mm in view of a difference in brand of carbonized coke depending on applications thereof for iron-making, casting, general-purpose and the like.

Further, carbonized coke which has been subject to a carbonization treatment in coke oven facilities and then a quenching treatment in quenching facilities for every formulation lot or carbonized coke obtained by carbonizing stock coal of each formulation lot which has been formulated according to the predetermined procedure is unloaded from the coke oven facilities for every formulation lot and then subject to pulverization and grading in turn so as to be conformed to various applications for iron-making, casting, general-purpose and the like. For example, in a specified coke production factory, in order to conform the unloaded carbonized coke to coke products up to about sixty kinds, the carbonized coke is pulverized and graded in order, resulting in providing a final coke product for shipment.

In particular, a general-purpose coke product is closely defined and classified in particle size accuracy at every brand. Thus, pulverization and grading of the carbonized coke is essential for particle size management of a coke product.

Now, a particle size management system of a coke product by pulverization and grading of carbonized coke which is conventionally carried out in the art will be described hereinafter with reference to FIG. 16.

The conventional particle size management system shown in FIG. 16 includes a first weighing equipment 21 for weighing carbonized coke A° carbonized, unloaded from a coke oven, quenched and then extracted for every formulation lot. Also, it includes a screen classifier 22 for carrying our screening and grading of the carbonized coke A° and carbonized coke $A^+$ pulverized in a pulverization step described hereinafter. For this purpose, the screen classifier 22 includes a plurality of screens arranged so as to classify the carbonized coke A° into a plurality of particle size ranges. For example, it may include a first screen **22*a* arranged on an upper side for permitting carbonized coke $A^+$ above a predetermined particle size range to be left thereon and carbonized coke A within the predetermined particle size range and carbonized coke $A^-$ below the range to pass therethrough and a second screen 22*b*** arranged on a lower side for permitting the carbonized coke A within the range to be left thereon and the carbonized coke $A^-$ below the range to pass therethrough.

Reference numeral 23 designates a pulverization equipment for pulverizing the carbonized coke $A^+$ left on the first screen **22*a*. The coke $A^+$ is fed to the pulverization equipment 23 by reflux by means of a pulverization feed system 24, followed by pulverization therein. The coke $A^+$ thus pulverized is fed as carbonized coke A° to the first screen 22*a*. Reference numeral 25 is a second weighing equipment for weighing the carbonized coke A within the predetermined particle size range left on the second screen 22*b* and a coke product B graded into the predetermined range. The coke product B is weighted by the second weighing equipment 25**, followed by shipment.

Thus, in the conventional pulverization and grading system constructed as described above, the carbonized coke A° which has been carbonized, unloaded from the coke oven, quenched and then extracted is weighed through the first weighing equipment 21 in order and then successively fed to the screen classifier 22 for screening. More particularly, in the screen classifier 22, the carbonized coke A° successively fed to the screen classifier 22 is classified through the first screen **22*a* on the upper side, resulting in the carbonized coke $A^+$ above the predetermined particle size range being left thereon and the carbonized coke A within the range and the carbonized coke $A^-$ below the range being passed therethrough. Then, the carbonized cokes A and $A^-$ passing through the first screen 22*a* are subject to screening through the second screen 22*b* on the lower side, so that the carbonized coke A within the range is left on the screen 22*b*** and the carbonized coke $A^-$ is passed therethrough.

The carbonized coke $A^+$ above the predetermined particle size left on the first screen **22*a* is fed to the pulverization equipment 23 by reflux by means of the pulverization feed system 24 and then pulverized into carbonized coke A° thereby, which is then fed to the first screen 22*a***, followed by being screened for grading. Then, the above-described procedure is repeated until the carbonized coke $A^+$ is finally pulverized into the carbonized coke A within the predetermined particle size range and therefore the coke product B of a desired particle size.

The carbonized coke A passing through the first screen **22*a* but left on the second screen 22*b* and the carbonized coke $A^-$ below the range below the range including excessively pulverized carbonized coke are subject to a subsequent treatment. More particularly, the carbonized coke $A^-$ is regarded to be the coke product B pulverized into a desired particle size it is already within the predetermined particle size range, resulting in being stored in a coke yard 31 for shipment. Alternatively, it may be weighed through the second weighing equipment 25 and then shipped in a carrying vessel 32** for shipment. The carbonized coke $A^-$ below the predetermined particle size range is regarded to be a coke product $B^-$ which fails to meet predetermined requirements and subject to a suitable treatment such as storage.

Unfortunately, the conventional coke oven operation management system constructed as described above fails to permit operations between the sections and in the sections to be constantly carried out in a consistent manner, leading to waste of time and labor. For example, various kinds of stock coal is used to product various kinds of coke products, therefore, it is required to arrange a number of processing lines for each of stock coal and coke and correspondingly running and management of the lines require abundant experience and much labor of skilled operators.

Also, the above-described conventional formulation management of each kind or brand of stock coal pulverized or the coal formulation design acting as an essential factor for determining quality of a coke product or calculation of a formulation ratio is conventionally executed on the basis of stock coal dried. More particularly, when formulation of each kind of pulverized stock coal is to be carried out in the pulverization and formulation step for every application, it is required to measure a water content of the coal prior to introduction of the coal into the coal yard 1201 or each of the formulation tanks 1232 to correct the formation ratio based on the water content thus measured. The correction is conventionally carried out on the basis of an average water content of the coal obtained during a specified period of time or for years. For this purpose, it is corrected on the basis of actual results of water content measurement obtained in the preceding year.

However, a water content of each brand of coal is widely varied depending on a coal-producing district. For example, it is varied depending on weather or other conditions. Therefore, simple correction which is carried out on the basis of the water content obtained empirically as described above fails to provide a formulation ratio which meets predetermined requirements, leading to a deterioration in quality of a coke product.

Further, in the conventional particle size management of each kind of pulverized coal which is executed as described above, analytical results of a particle size of each brand of pulverized stock coal and average results of water content and particle size measurement of each brand of formulated stock coal result in the pulverization slit width of the pulverization blades of the impeller breaker 1211 being manually adjusted, to thereby cause disadvantages. More particularly, the pulverization blades of the impeller breaker 1211 each are gradually worn at an edge thereof with repeating of the pulverization. Therefore, it is generally required to measure the pulverization slit width in a pulverization chamber to adjust it every time when the pulverization is carried out. Unfortunately, it is substantially impossible to frequently measure wear of the pulverization blades and the pulverization slit width. Thus, in the prior art, an operator skilled considers measurement results of a particle size of pulverized coal, to thereby visually empirically adjust the slit width. Unfortunately, this leads to a significant variation in particle size of pulverized coal from a predetermined target value.

In the conventional coke product particle size management system executed as described above, it is known that the carbonized coke $A^+$ within the predetermined particle size range which is left on the first screen **22*a* and then successively fed to the pulverization equipment 23 by reflux by means of the pulverization feed system 24, followed by being pulverized by the pulverization equipment 23 is varied in quantity with time due to a variation in particle size distribution of the carbonized coke A° which is raw coke, a variation in screening efficiency of the screen classifier 22 and the like. Thus, in order to adjust pulverization performance of the pulverization equipment 23 depending on the quantity of carbonized coke $A^+$ fed through the pulverization feed system 24** to pulverize it into a particle size required for the carbonized coke A and coke product B, it is required to adjust a rotational speed of the pulverization blades to prevent excessive pulverization of the carbonized coke $A^+$, to thereby accomplish appropriate particle size management of the coke product B, an improvement in yields of the coke product and effective energy-saving.

In view of the above, in the prior art, the quantity of carbonized coke $A^+$ fed by reflux through the pulverization feed system 24 is visually judged by the operator 26 skilled, so that a rotational speed of the pulverization equipment 23 is artificially adjusted by hand **26*b* in view of results of the judgment. However, visual judgment 26*a* by the operator 26 and adjustment of the pulverization equipment 23 by hand 26*b* fail to constantly appropriately control pulverization performance of the pulverization equipment in correspondence to the quantity of carbonized coke $A^+$ fed through the feed system 24** which is varied with time, leading to an increase in a defective coke product failing to satisfy the predetermined requirements.

SUMMARY OF THE INVENTION

The present invention has been made in view of the foregoing disadvantages of the prior art.

Accordingly, it is an object of the present invention to provide an operation management system for a coke oven which is capable of accomplishing unified management of an operation extending from receiving of stock coal to production and shipment of coke through management and control processing by means of a computer.

It is another object of the present invention to provide a coal formulation accuracy management system in coke oven operation management which is capable of readily carrying out optimum coal formulation accuracy management depending on the kind of stock coal pulverized by control processing using a computer.

It is a further object of the present invention to provide a coal particle size management system in coke oven operation management which is capable of accomplishing particle size management of pulverized coal depending on the kind of stock coal by control processing using a computer.

It is still another object of the present invention to provide a coke particle size management system in coke production which is capable of appropriately and effectively carrying out automatic pulverization and grading of carbonized coke (raw coke) of each formulation lot to provide an optimum particle size for a coke product.

In order to accomplish the above-described objects, the present invention carries out management of an operation in a head office, branch offices and a production site extending from receiving of various kinds of stock coal to production and shipment of various kinds of coke in coke production in a concern and in an operation of a coke oven therein and control processing for the management based on unified management by means of a general-purpose computer, a process computer and a distributed control system (hereinafter referred to also as "DCS").

In accordance with one aspect of the present invention, a unified operation management system for a coke oven in a concern of production, sale and self-consumption of coke and coke-based products is provided. The system comprises processes carried out on a side of a head office of the concern and branch offices thereof and processes carried out in a production adjustment and management section of a coke production factory affiliated with the concern and a product production section thereof. The processes on the side of the head office and branch offices include a process of determining basic schedules for production and shipment of coke and receiving of stock coal based on information on sale and self-consumption depending on a user's demand for coke and incoming information on stock coal from a colliery, for example, for every month and a process of notifying the production adjustment and management section of the coke production factory of the basic schedules and requesting the production adjustment and management section of shipment of coke based on the user's demand and instruct the production adjustment and management section to receive stock coal. The processes in the production adjustment and management section of the coke production factory includes a process of preparing a primary schedule for each of production and shipment of coke and receiving of stock coal for every predetermined months such as, for example, for every 1 to 3 months based on the notified basic schedules for the production and shipment of coke and receiving of stock coal and a secondary detailed schedule for production and shipment of coke and receiving of stock coal for every day day of the month concerned, a process of carrying out management of the quantity of coke already stored, and management of the quantity of stock coal already stored and the quantity of stock coal received for every day concerned, and a process of carrying out formulation design of stock coal in view of quality of stock coal, quality of coke, carbonization conditions and the like, and preparing a daily coke oven running schedule between the product production section in which pulverization and formulation of stock coal is carried out and the production adjustment and management section under the stored coke quantity management and a pulverization and formulation running schedule for pulverization and formulation of stock coal according to daily formulation instructions under the stored coal quantity management. The processes in the product production section including a process of practicing a running operation for pulverization and formulation of stock coal according to the pulverization and formulation running schedule and charging the coke oven with stock coal pulverized and formulated by the running operation, and a process of practicing a running operation of the coke oven to subject the charged stock coal to a carbonization treatment, to thereby produce coke. The processes between the head and branch offices and the coke production factory and in the head and branch offices and coke production factory and the processes between the production adjustment and management section and the product production section and in the sections are managed and controlled by means of a computer.

In accordance with this aspect of the present invention, a unified operation management system for a coke production plant by means of a computer in a concern of production and sale and self-consumption of coke and coke-based products is provided. The system includes a factory management computer arranged in a coke production factory affiliated with the concern, and a plant running management computer, a plant running monitoring and controlling computer and a coke oven control computer arranged in a production adjustment and management section of the coke production factory and a product production section thereof. The factory management computer is used for carrying out management of a whole management control system based on operation management information on a request for shipment of a coke product of each kind and receiving of stock coal of each kind input thereto from the head office and branch offices. The plant running management computer is used for controlling the whole coke production plant based on operation management information on a request for shipment of a coke product of each kind and receiving of stock coal of each kind transmitted from the factory management computer, operation management information prepared so as to meet predetermined requirements and input thereto from the production adjustment and management section through the factory management computer, information on receiving of each kind of stock coal prepared for every month and every day, information on pulverization and mixing of the coal, a schedule for production and shipment of a coke product of each kind, management of stored coke quantity, management of stored coal quantity and formulation design of the coal, and information on a product running schedule for every month and every day and a pulverization and formulation operation schedule which is input thereto from the product production section through the factory management computer. The plant running monitoring and controlling computer is used for carrying out synthetic running monitoring and controlling of processing plants each arranged for storage and pulverization/formulation of each kind of stock coal, coke oven plants each arranged for carbonization of stock coal formulated and processing plants each arranged for pulverization/grading and storage of each kind of coke product based on instructions from the plant running management computer. The coke oven control computer is used for controlling each of coke ovens constituting a coke oven group based on instructions from the plant running management computer.

In the coke oven operation management system of the present invention constructed as described above, the head office and branch offices determine basic schedules for production and shipment of coke and receiving of stock coal based on information on sale and self-consumption depending on a user's demand for coke and incoming information on stock coal from a colliery, for example, for every month and notify the production adjustment and management section of the coke production factory of the basic schedules, request the production adjustment and management section of shipment of coke based on the user's demand and instruct the production adjustment and management section to receive stock coal.

The production adjustment and management section of the coke production factory prepares a primary schedule for each of production and shipment of coke and receiving of stock coal for every predetermined months such as, for example, for every 1 to 3 months based on the notified basic schedules for the production and shipment of coke and receiving of stock coal and a secondary detailed schedule for production and shipment of coke and receiving of stock coal for every day day of the month concerned, carries out management of the quantity of coke already stored, and management of the quantity of stock coal already stored and the quantity of stock coal received for every day concerned, and carries out formulation design of stock coal in view of quality of stock coal, quality of coke, carbonization conditions and the like, and prepares a daily coke oven running schedule between the product production section in which pulverization and formulation of stock coal is carried out and the production adjustment and management section under the stored coke quantity management and a pulverization and formulation running schedule for pulverization and formulation of stock coal according to daily formulation instructions under the stored coal quantity management.

The product production section executes a running operation for pulverization and formulation of stock coal according to the pulverization and formulation running schedule and charging the coke oven with stock coal pulverized and formulated by the running operation and executes a running operation of the coke oven to subject the charged stock coal to a carbonization treatment, to thereby produce coke. The operations between the head and branch offices and the coke production factory and in the head and branch offices and coke production factory and the processes between the production adjustment and management section and the product production section and in the sections are managed and controlled by means of a computer.

Also, in the coke oven operation management system of the present invention, the factory management computer acts to carry out management of a whole management control system based on operation management information on a request for shipment of a coke product of each kind and receiving of stock coal of each kind input thereto from the head office and branch offices. The plant running management computer functions to control the whole coke production plant based on operation management information on a request for shipment of a coke product of each kind and receiving of stock coal of each kind transmitted from the factory management computer, operation management information prepared so as to meet predetermined requirements and input thereto from the production adjustment and management section through the factory management computer, information on receiving of each kind of stock coal prepared for every month and every day, information on pulverization and mixing of the coal, a schedule for production and shipment of a coke product of each kind, management of stored coke quantity, management of stored coal quantity and formulation design of the coal, and information on a product running schedule for every month and every day and a pulverization and formulation operation schedule which is input thereto from the product production section through the factory management computer. The plant running monitoring and controlling computer functions to carry out synthetic running monitoring and controlling of processing plants each arranged for storage and pulverization/formulation of each kind of stock coal, coke oven plants each arranged for carbonization of stock coal formulated and processing plants each arranged for pulverization/grading and storage of each kind of coke product based on instructions from the plant running management computer. The coke oven control computer serves to control each of coke ovens constituting a coke oven group based on instructions from the plant running management computer.

In accordance with another aspect of the present invention, there is provided a coal formulation accuracy management system in a pulverization treatment of various kinds of stock coal for every brand received from the outside for management of formulation accuracy of the stock coal pulverized for the purpose of producing a coke product such as coke for iron-making, foundry coke, general-purpose coke and the like. The system includes a process of carrying out carrying-in of the pulverized stock coal with respect to each of formulation tanks of a formulation system at every pulverization by means of a pulverization carrying-in system according to daily instructions on pulverization and formulation of the stock coal to subject it to a formulation treatment and carrying the formulated stock coal to a coal bin tank by means of a carrying system to charge it to a coke oven. The pulverization carrying-in system is provided with a water content measuring means for measuring a water content of the pulverized stock coal at every pulverization to provide water data which is input a process computer. The process computer corrects a formulation ratio of the pulverized stock coal depending on the input water data.

In the coal formulation accuracy management system of the present invention thus constructed, the water content measuring means measures a water content of the pulverized stock coal. Results of the measurement are then input to the process computer, resulting in a water content of stock coal to be formulated calculated in real time to correct a formulation ratio, so that formulation of stock coal may be accomplished at a desired formulation ratio.

In accordance with a further aspect of the present invention, there is provided a coal particle size management system in a pulverization treatment of various kinds of stock coal for every brand received from the outside for particle size management of pulverized stock coal for the purpose of producing a coke product such as coke for iron-making, foundry coke, general-purpose coke and the like. The system includes a process of pulverizing, according to daily instructions on pulverization and formulation of the stock coal, the stock coal into a predetermined particle size by means of a coal pulverization means arranged in a coal pulverization carrying-in system and including pulverization blades of which a pulverization slit width is adjustably defined, carrying out carrying-in of the pulverized stock coal with respect to each of formulation tanks of a formulation system to subject it to a formulation treatment, and carrying the formulated stock coal to a coal bin tank by means of a carrying system to charge it to a coke oven. The coal pulverization carrying-in system is provided with a particle size measurement means for measuring a particle size of the pulverized stock coal. The particle size measurement means suitably carries out sampling of the pulverized stock coal to analyze a particle size of the pulverized stock coal. The carrying-in system is provided with a water and particle size measurement means for measuring a water content of the formulated stock coal and a particle size thereof. Data on the particle size of the pulverized coal and data on the water content and particle size of the formulated coal are input to a process computer. The process computer automatically adjusts the pulverization slit width of the coal pulverization means depending on the data input thereto to adjust a particle size of the stock coal pulverized to a desired set value.

In the coal particle size management system of the present invention constructed as described above, the particle size measuring means measures a particle size of pulverized stock coal. More particularly, the particle size measurement means suitably carries out sampling of the pulverized stock coal to analyze a particle size of the pulverized stock coal. The water and particle size measurement means measures a water content of the formulated stock coal and a particle size thereof. Data on the particle size of the pulverized coal and data on the water content and particle size of the formulated coal are input to the process computer, which carries out operation processing of the data to automatically adjust the pulverization slit width of the coal pulverization means. Thus, wear of the pulverization blades may be readily estimated to constantly keep the slit width of the pulverization blades sufficient to permit stock coal to be pulverized into a desired particle size, to thereby substantially eliminate a variation in particle size of pulverized coal depending on a brand of coal and the like. Thus, the present invention ensures unified management of a particle size of pulverized coal by means of the computer.

In accordance with still another aspect of the present invention, a particle size management system for a coke product in coke production is provided. The system includes a screen classifier for screening carbonized coke extracted for every formulation lot to subject it to grading. The screen classifier includes at least a first screen constructed for leaving carbonized coke above a predetermined particle size range thereon and passing carbonized coke within and below the predetermined particle size range therethrough and a second screen constructed for leaving the carbonized coke within the predetermined particle size range thereon and passing the carbonized coke below the predetermined particle size range therethrough. The carbonized coke above the predetermined particle size range left on said first screen is successively fed to a pulverization equipment for pulverization and then returned to the first screen for screening, followed by repeating the procedure to leave the carbonized coke within the predetermined particle size range on the second screen and the carbonized coke within the predetermined particle size range left on the second screen is extracted as a coke product graded. The system also includes a weighing equipment for measuring the quantity of carbonized coke above the predetermined particle size range fed from the first screen to the pulverization equipment in order and a pulverization control unit for controlling pulverization performance of the pulverization equipment depending on the quantity of carbonized coke successively measured by the weighing equipment.

In the coke particle size management system of the present invention constructed as described above, the carbonized coke above the predetermined particle size range left on the first screen is fed to the pulverization equipment by reflux for pulverization, during which the quantity of carbonized coke above the range fed to the pulverization equipment is successively measured, so that pulverization performance is adjusted depending on the quantity. Thus, pulverization of carbonized coke by the pulverization equipment is satisfactorily executed while minimizing pulverization of coke into a particle size below the predetermined range.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 6, 6*a* and 6*b* are schematic views showing an outline of preparation of large-scale scheduling in the operation management system of FIG. 1;

FIG. 7, 7*a* and 7*b* are schematic views showing details of preparation of the large-scale scheduling of FIG. 6;

FIG. 9, 9*a*, 9*b*, and 9*c* are schematic views showing details of preparation of each of the medium-scale scheduling and small-scale scheduling of FIG. 8;

DETAILED DESCRIPTION OF THE PREFERRED EMBODIMENTS

Now, an operation control system for a coke oven according to the present invention will be described hereinafter with reference to the accompanying drawings.

Referring first to FIGS. 1 to 9, an embodiment of an operation management system for a coke oven according to the present invention is illustrated. The illustrated embodiment is directed to operation management for a coke production plant using a computer.

An operation management system of the illustrated embodiment is adapted to carry out, by means of a computer system, management and control processing of an operation of a coke production plant of a concern extending from receiving of various kinds of stock coal to production and shipment of various kind of coke products. More particularly, the illustrated embodiment is adapted to determine, in order to more efficiently accomplish the operation, large-scale scheduling for production of coke products extending over future several months, medium-scale scheduling therefor for every month and small-scale scheduling therefor for every day on the basis of sales information and anticipated sales information from a head office and branches of the concern, receiving information for every kind of stock coal and other predetermined information; input each scheduling to a factory management computer; and then form an FA network, by means of a plant running management computer, between the plant running management computer and a plant running monitoring and controlling computer (DCS) of each of operation sites according to instructions from the factory management computer to construct a quantitative computer control system, to thereby practically and effectively carry out unified management of the operation.

Figure 1:
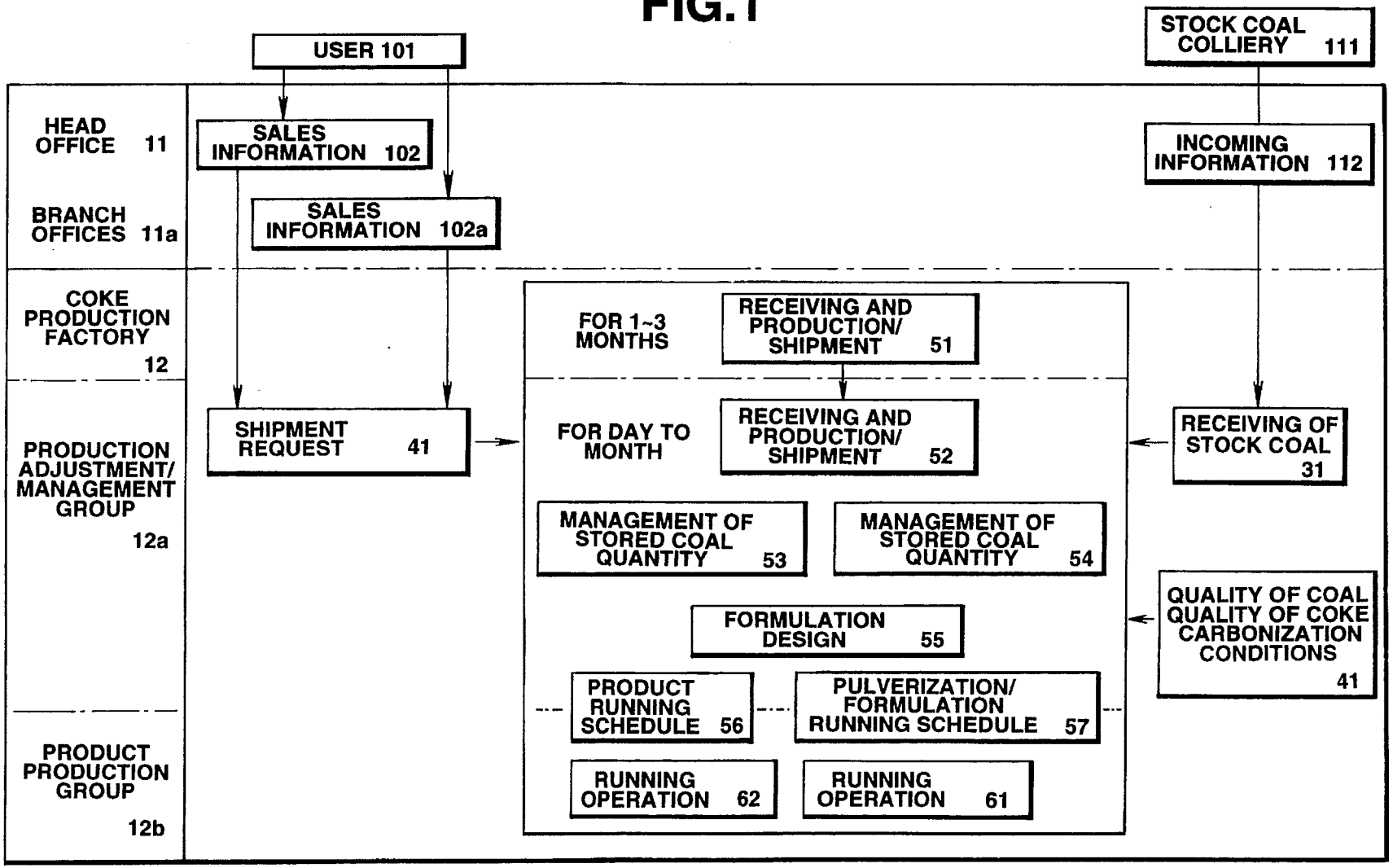
FIG. 1 is a flow chart showing an operation management system for a coke oven according to an embodiment of the present invention.

The operation management system of the illustrated embodiment adapted to be thus executed for the coke production plant is schematically shown in FIG. 1.

More particularly, as shown in FIG. 1, a head office 11 and branch offices 11*a* of a concern of production, sale and/or self-consumption of a coke product and a coke-based product each gather sales information 102, 102*a* depending on a demand for various kinds of coke products by each of users 10 or a demand for various kinds of coke products for iron-making, casting, general-purpose and the like to make a shipment request 21 of coke products based on the demand to a production adjustment and management group 12*a* of an affiliated coke production plant 12 and instruct the production adjustment and management group 12*a* to carry out receiving 31 of stock coal depending on stock coal receiving information 112 input to the head office 11 from collieries 111 of stock coal including imported stock coal.

The production adjustment and management group 12*a* of the coke production factory 12 makes medium-scale to large scale scheduling 51 extending for predetermined months such as 1 to 3 months for receiving of various kinds of stock coal and production and shipment of various kinds of coke products and detailed scheduling 52 for receiving of various kinds of stock coal and production and shipment of various kinds of coke products for each day in the predetermined months. Also, the production adjustment and management group 12*a* is adapted to make stored coke quantity management 53 and stored coal quantity management 54 for managing stored stock coal and newly received stock coal.

Also, the production adjustment and management group 12*a* makes detailed coal formulation design 55 in view of quality of stock coal, quality of coke and carbonization conditions 41 and prepares a daily coke oven running schedule or a daily product running schedule 56 in cooperation with a production group 12*b* for carrying out production of coke, as well as pulverization and formulation of stock coal under the stored coke quantity management 53. Concurrently, the production adjustment and management group 12*a* prepares a pulverization and formulation running schedule 57 for pulverization and formulation of stock coal according to daily formulation instructions under the stored coal quantity management 54.

Further, the product production group 12*b* carries out a former-stage running operation 61 for pulverization and formulation of stock coal according to the pulverization and formulation running schedule 57 and then charges a coke oven with pulverized and formulated stock coal according to the product running schedule 56 to subject the coal to carbonization, pulverization and grading, resulting in a latter-stage running operation 62 for production of coke products being executed.

Figure 2:
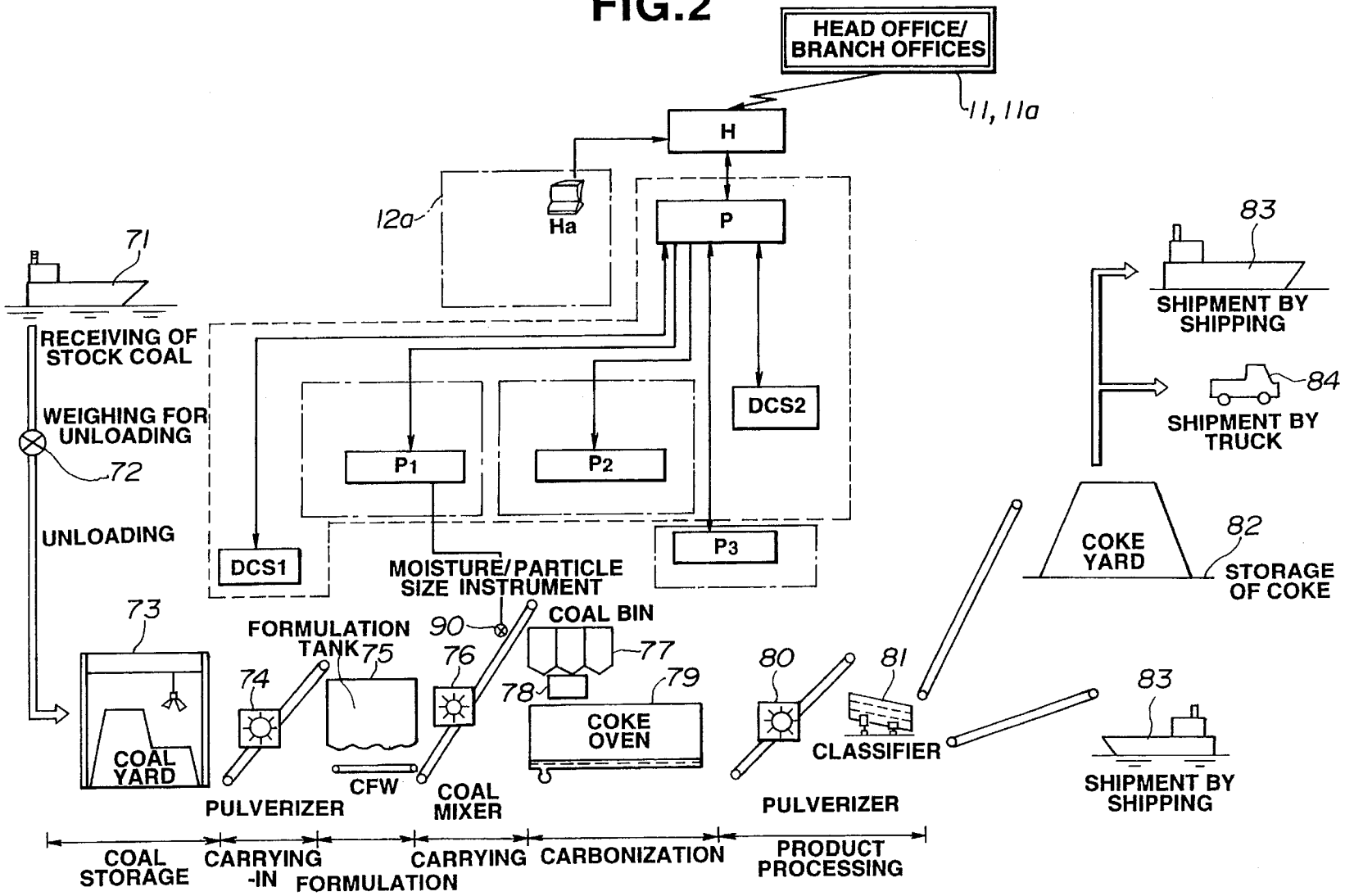
FIG. 2 is a flow chart generally showing the operation management system of FIG. 1.

FIG. 2 shows a general construction of each of production plants at the coke production factory 12 to which the operation management system of the illustrated embodiment extending from receiving of stock coal of each kind to production and shipment of a coke product of each kind is applied. In FIG. 2, reference numeral 71 designates a carrying vessel 71 for stock coal such as domestic coal or imported coal, 72 is an unloading weighing equipment for weighing stock coal of each kind unleaded from the carrying vessel 71, and 73 is a coal yard for storing unloaded stock coal for every brand.

Reference numeral 74 designates a coal pulverizer for pulverizing stock coal of each brand fed thereto into a predetermined particle size, 75 is a formulation tank for temporarily storing pulverized stock coal for every brand and 76 is a coal mixer for mixing various brands of pulverized stock coal fed from the formulation tank 75. The coal mixer 76 is provided with a moisture and particle size measuring equipment 90 for measuring a moisture content of the pulverized stock coal and a particle side thereof.

Reference numeral 77 indicates a coal bin for receiving stock coal formulated as described above, 78 is a charging vehicle for charging a coke oven with the formulated stock coal, and 79 is a coke oven group including coke ovens each adapted to carbonize the charged stock coal therein.

Reference numeral 80 designates a coke pulverizer for pulverizing the carbonized coke into a predetermined particle size, 81 is a screen classifier for screening the carbonized and pulverized coke to subject it to grading, 82 is a coke yard for storing the screened coke product, 83 is a coke carrying vessel for shipping the product coke and 84 is a truck.

Now, the illustrated embodiment will be more detailedly described with reference to FIG. 2. Operation management information including the shipment request 21 of the coke product based on the sales information 102, 102*a* of a coke product in the head office 11 and branch offices 11*a* and receiving of stock coal based on the coal receiving information 112 is input to a factory management computer H for managing the whole operation management system and then displayed on a CRT of an input and output terminal Ha arranged at each of associated business establishments including the production adjustment and management group 12*a* and product production group 12*b*. Concurrently, the operation management information causes pulverization and formulation of the coal of each kind, running and operation of the coke oven, and pulverization and grading of the coke product to be carried out through the computer H, followed by being transmitted to a plant running management computer P for controlling the whole coke production plant. Also, various kinds of related information including, for example, marine transportation information on incoming of the stock coal, marine and land transportation information on shipping of the coke product and the like is input from the terminal Ha through the computer H to the computer P.

More particularly, in the production adjustment and management group 12*a*, the operation management information prepared under the above-described conditions is input through the computer H to the computer P. Also, various kinds of management information including information prepared for every month and every day in relation to receiving, pulverization and mixing of each kind of stock coal, a production schedule 51 for each kind of coke product and a shipment schedule 52 therefor, stored coke quantity management 53, stored coal quantity management 54, and formulation design 55 is input to the computer P. Further, recording information required in association with the above-described management information such as, for example, a delivery schedule, information on an analytical value of each of the stock coal and coke product, information on past results of receiving of the stock coal, information on physical distribution in the production factory 12, information on quality control and other related information is likewise input to the computer P.

In the product production group 12*b*, information on carrying-in, pulverization and formulation of the stock coal prepared on the basis of the above-described management information and related information and running information on a daily product running schedule 56 and a daily pulverization and formulation running schedule 57 are input through the computer H to the computer P.

The computer P includes plant running monitoring and controlling computers for synthetically and wholly monitoring and controlling coke production plants including processing plants 72 to 76 for storage and pulverization/formulation of each kind of stock coal, coke oven plants 77 to 79 for carbonization of the formulated stock coal, processing plants 80 to 82 for pulverization/grading and storage of the coke product, and the like. In the illustrated embodiment, the plant running monitoring and controlling computers include a plant running monitoring and controlling computer DCS1 on a side of the stock coal and a plant running monitoring and controlling computer DCS2 arranged on a side of the coke product. The computer P also includes a computer P1 for management of a moisture content of the pulverized and formulated stock coal and a particle size thereof by means of a moisture and particle size measuring equipment 90 and coke oven control computers P2 and P3 for the coke oven group 79.

The production group **12*b* carries out the former-stage running operation 61 for pulverization and formulation of the stock coal based on the pulverization and formulation running schedule 57 and the latter-stage running operation 62 based on the product running schedule 56** in a manner to charge the coke oven with the pulverized and formulated stock coal to subject it to carbonization, pulverization and grading, to thereby prepare the coke product.

A general procedure of the operation extending from receiving of each kind of stock coal to production and shipment of each kind of coke product is widely known in the art. In the system of the illustrated embodiment, the operation is carried out according to schedules described hereinafter as follows:

(A) The factory management computer H is used to carry out management of the whole management control system based on the operation management information such as the shipment request 21 of the coke product and receiving 31 of the stock coal directly input from the head office 11 and branch offices **11*a*** thereto.

(B) The plant running management computer P is used to control the whole coke production plant based on information. The information includes various kinds of operation management information on the shipment request 21 of the coke product and receiving 31 of the stock coal directly transmitted from the computer H thereto. Also, the information includes the operation management information prepared according to the above-described conditions and information on receiving, pulverization and formulation of each kind of stock coal prepared for every month and every day; various kinds of management information on the production schedule 51 of each kind of coke product and the shipment 52 thereof, the stored coke quantity management 53, the stored coal quantity management 54 and the formulation design 55; and related recording information required in association with the management information including, for example, a delivery schedule, analytical values of the stock coal and coke product, past results of shipment of the coke product and stock coal, physical distribution in the factory 12 and quality control, which are input from the production adjustment and management group **12*a* to the computer P. The information further includes various kinds of running information on the product running schedule 56 for every month and every day and the pulverization and formulation running schedule 57**.

(C) The plant running monitoring and controlling computers DCS1 and DCS2 are utilized to synthetically carry out, based on instructions from the computer P, running monitoring and controlling of the whole coke production plant including the processing plants 72 to 76 for storage and pulverization/formulation of the stock coal, coke oven plants 77 to 79 for carbonization of the formulated stock coal and processing plants 80 to 82 for pulverization/grading and storage of the coke product.

(D) The moisture and particle size management computer P1 is used to directly monitor a moisture content of the pulverized and formulated stock coal and a particle size thereof by means of the moisture and particle size measuring equipment 90.

(E) The coke oven control computers P2 and P3 are used to directly control the coke ovens of the coke oven group 79 based on instructions from the computer P.

Figure 3:
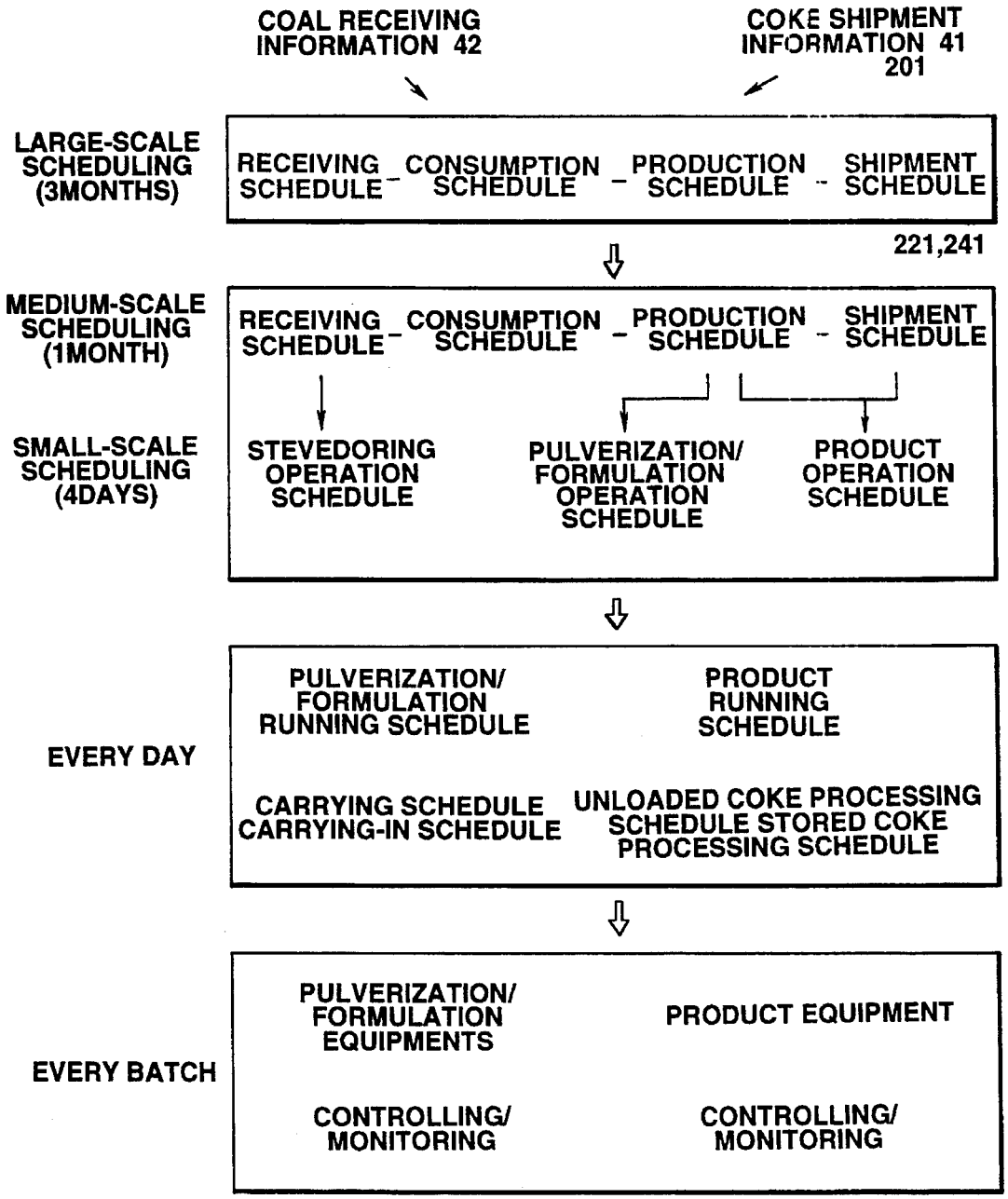
FIG. 3 is a flow chart showing a concept of the operation management system of FIG. 1.
Figure 4:
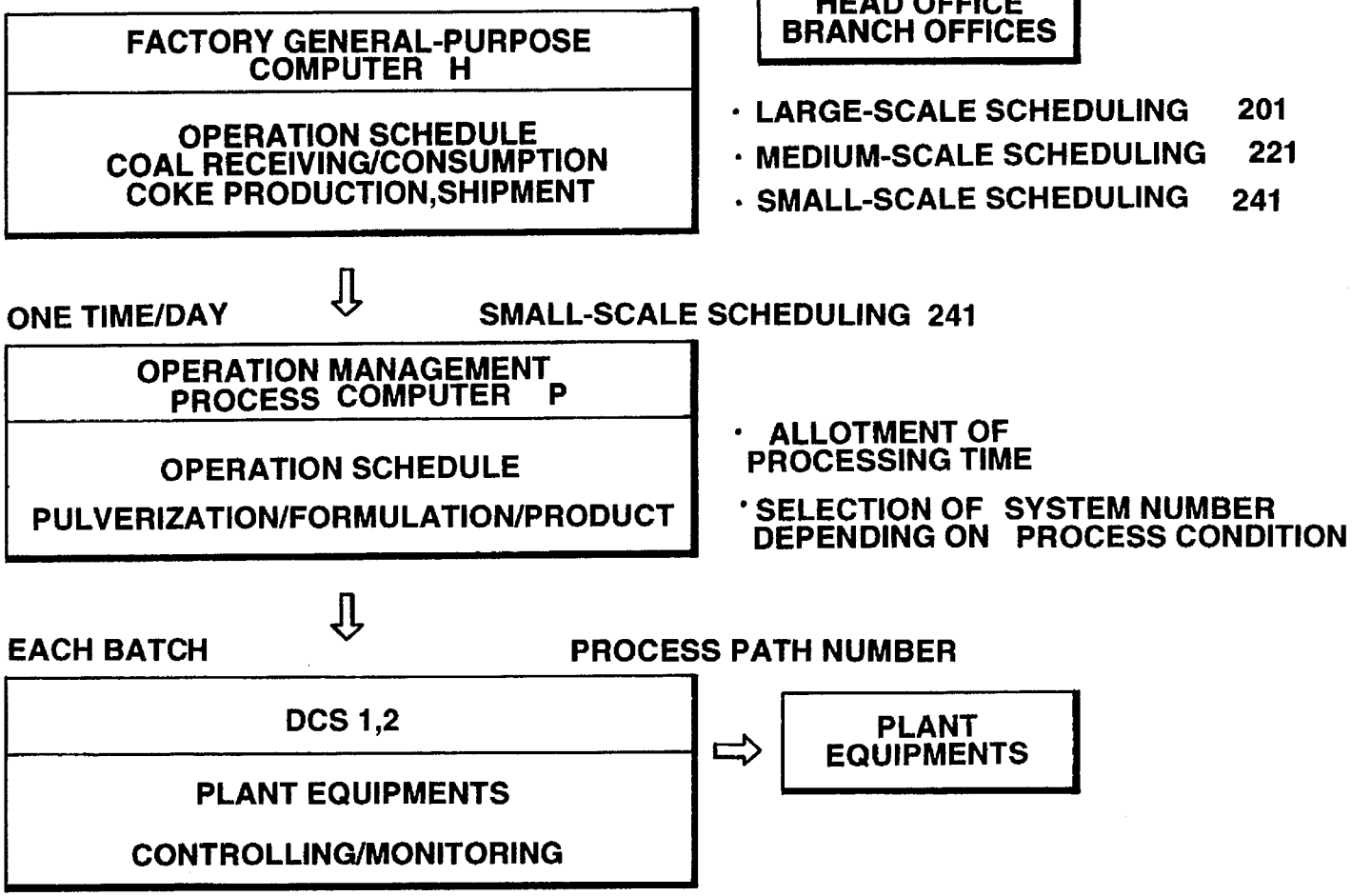
FIG. 4 is a flow chart showing a process extending from schedules including an operation schedule to running control in the operation management system of FIG. 1.
Figure 5:
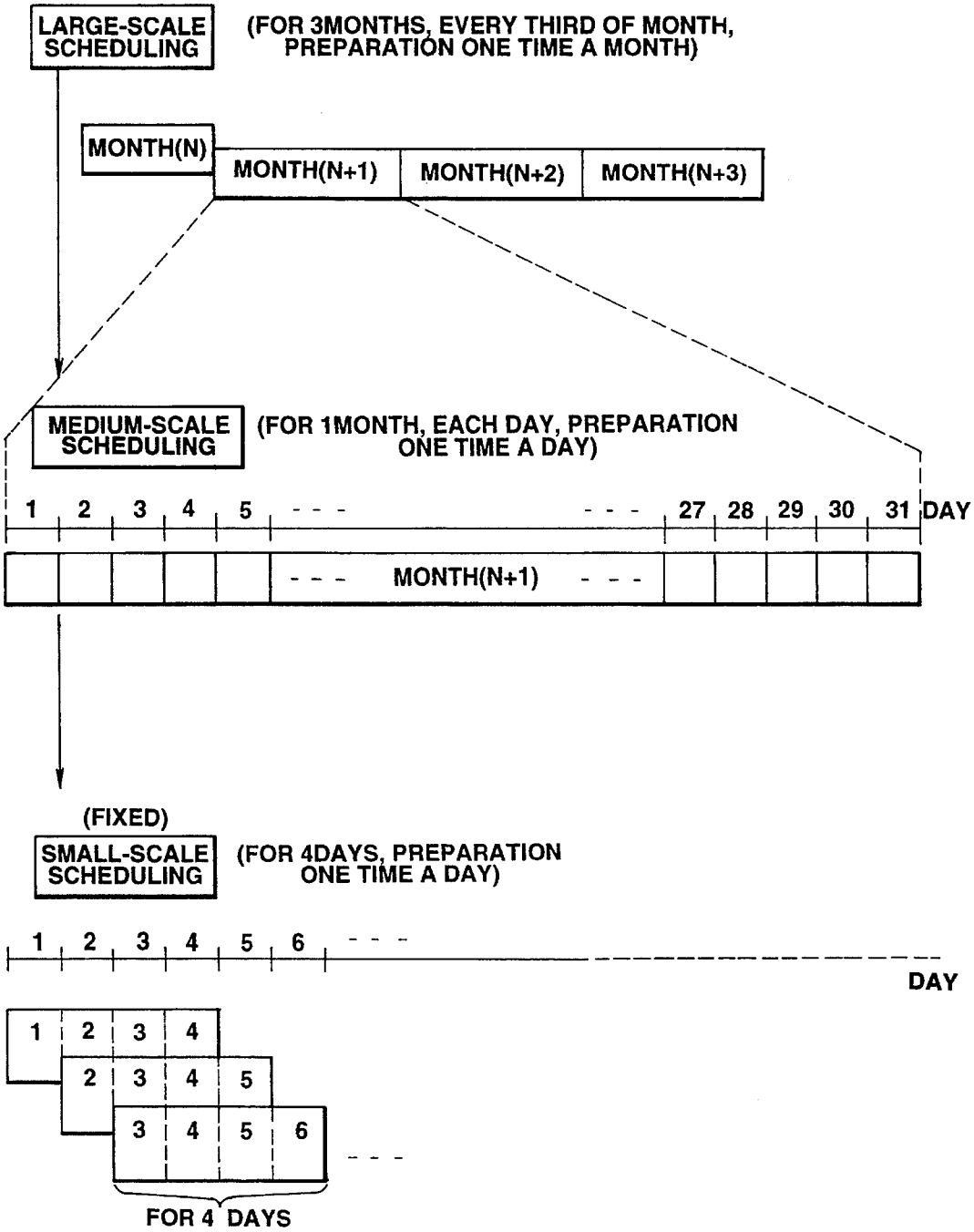
FIG. 5 is a schematic view showing a concept of preparation of an operation schedule in the operation management system of FIG. 1.

Now, an outline of a whole schedule in the operation management system of the coke production plant by means of the computers described above will be described hereinafter with reference to FIGS. 3 to 5, wherein FIG. 3 shows an outline of a whole schedule of the operation management system of the illustrated embodiment, FIG. 4 shows a flow form various schedules including the operation schedule to running control, and FIG. 5 shows a concept for preparation of the operation schedule.

The operation management system of the illustrated embodiment for the coke production plant is adapted to carry out unified control of information and data on the large-scale, medium-scale and small-scale operations each including receiving of each kind of stock coal, production thereof and shipment thereof and carry out preparation of various operation and running schedules and running of various plants and equipments based on the unified control. For this purpose, management of each of the operation, quality control and physical distribution effectively takes place according to a system construction described hereinafter.

More specifically, management information on the shipment request 21 of each of various kinds of coke products based on the sales information 102, **102*a* of the coke product including anticipated or prospective sales information extending over a future predetermined period of time as long as three months (month N+1, month N+2 and month N+3) and management information on receiving 31 of each kind of stock coal based on incoming information 112 of the stock coal are input from the head office 11 and branch offices 11*a* to the computer H, which prepares, based on the management information input thereto, balance between receiving and consumption of the stock coal and production and shipment of the coke product in the form of a large-scale scheduling 201**, for example, for each third of a month and corrects it as required.

An operation schedule for the month N+1 (next month) is prepared in the form of medium-scale scheduling 221 for every day based on information on receiving of the stock coal and shipment of the coke product for every day to confirm balance in quantity between the stock coal stored in the coal yard 73 and the coke product stored in the coke yard 82 and operation of the plants and equipments for unloading, pulverization/formulation and the like. The medium-scale scheduling is prepared about one time between the last third of each month and the end of the month.

The actual operation running is carried out, by means of the computer H, according to small-scale scheduling 241 prepared in the form of a fixed schedule for every future four days in view of the latest information on receiving of the stock coal, shipment of the coke product, as well as quality of the stock coal and quality of the coke product based on the medium-scale scheduling 221.

The small-scale scheduling 241 is output from the computer H to the computer P every day, so that the computer P prepares a running schedule for every working team in view of conditions set at each of the plants in connection with the above-described pulverization/formulation and coke product. The conditions include, for example, each of processing systems, a slit width of the pulverizer, a mesh size of the screen classifier and the like.

Then, instructions on running are fed from the computer P to each of the computers DCS1 and DCS2 for every processing batch according to the above-described running schedule, resulting in each of the plants 72 to 82 being activated and controlled running and monitoring of the activated plants 72 to 82 being carried out. Also, operation result information or information on actual results of the operation is feedbacked from the computers DCS1 and DCS2 to the computer P at every completion of each of the processing batches, so that the computer P epitomizes the operation result information for one day and feedbacks results of the epitomization to the computer H.

Thus, workers in the production group 12*b* can carry out actual operation running using the computer P and computers DCS1 and DCS2. In this instance, the moisture and particle size management computer P1 and coke oven control computes P2 and P3 are used in combination therewith.

Now, preparation of each of the large-scale scheduling 201, medium-scale scheduling 221 and small-scale scheduling 241 will be described.

I. Preparation of Large-Scale Scheduling

Figure 6:
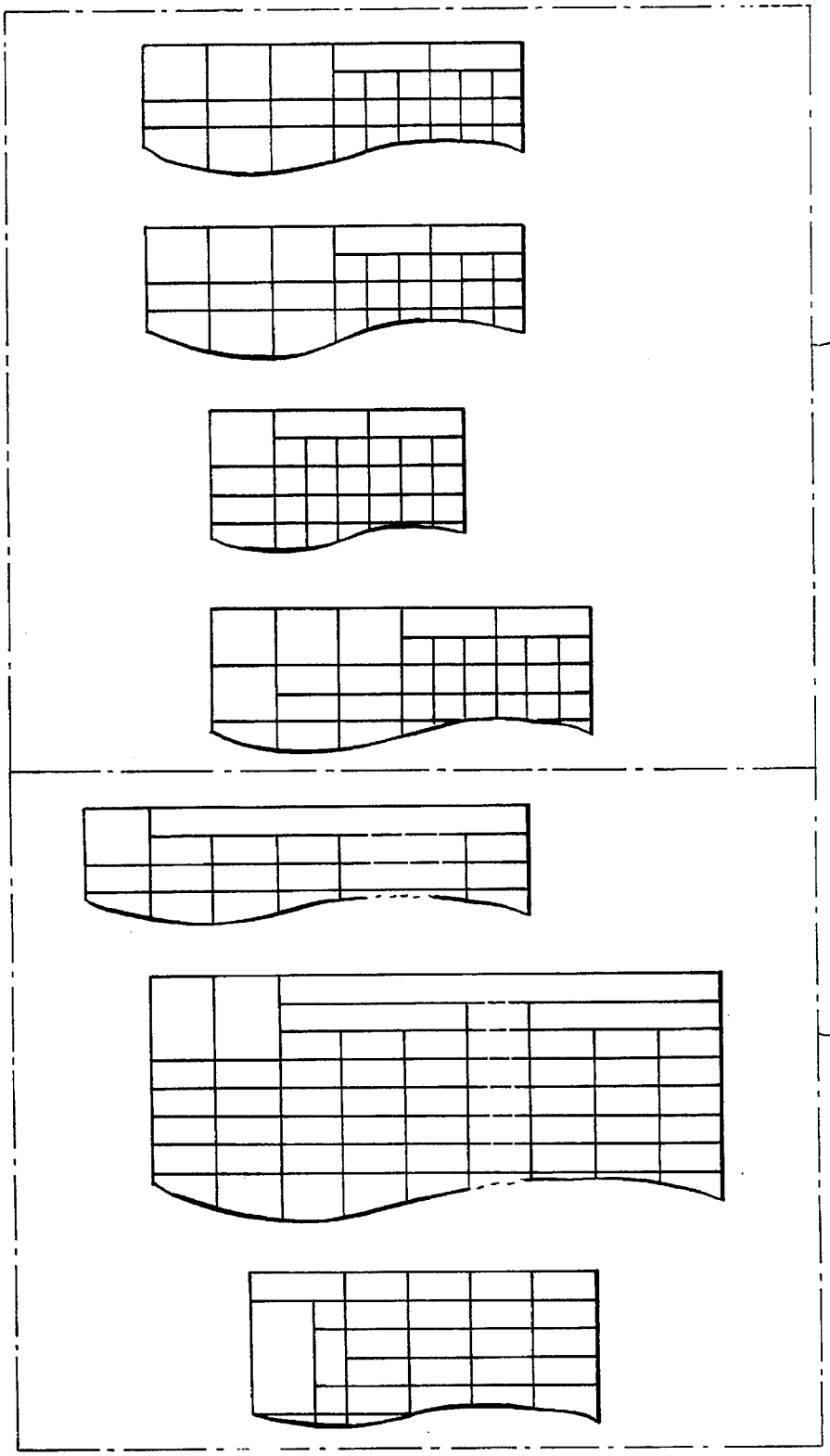
Figure 7:
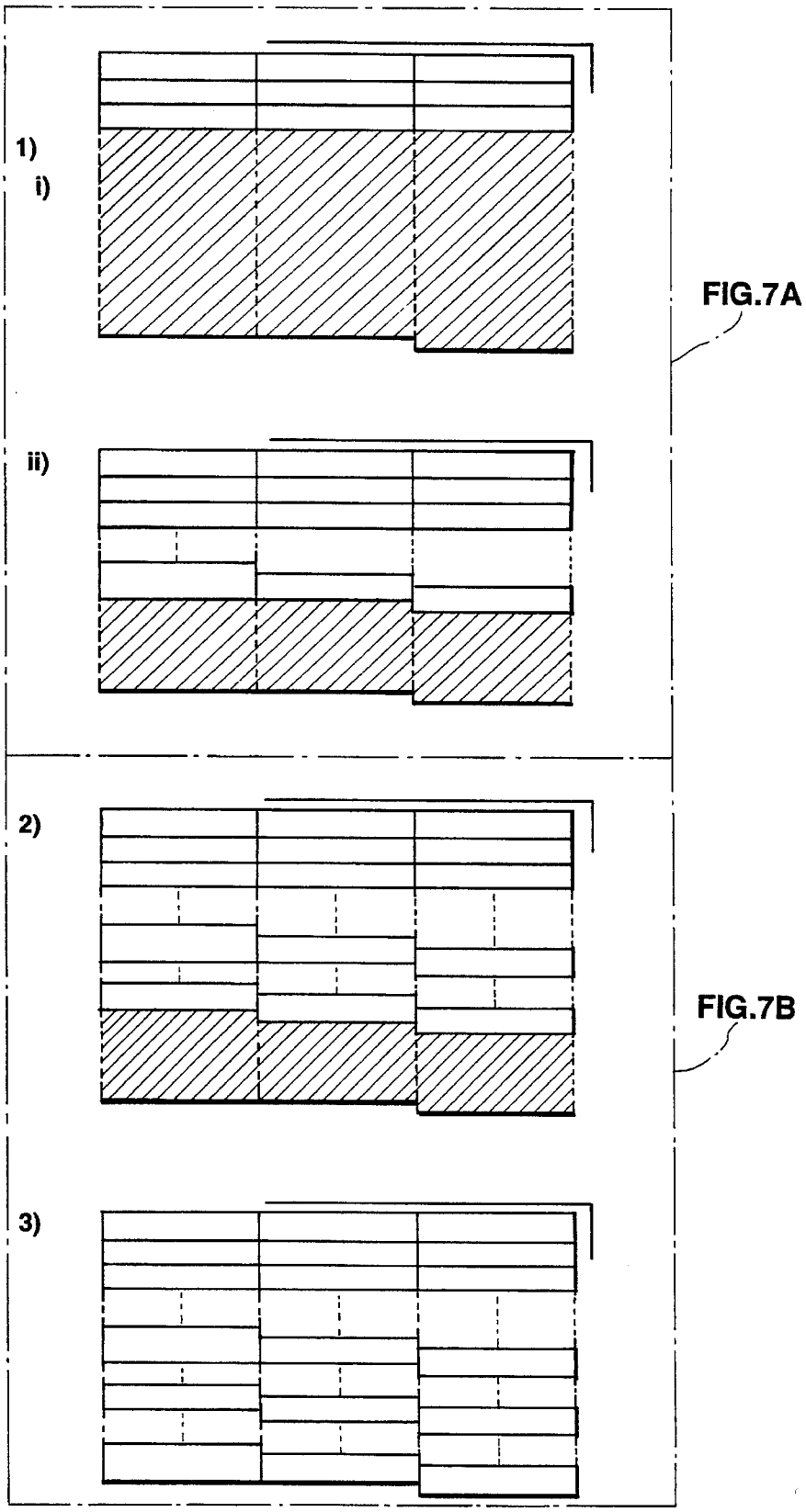
Figure 7B:
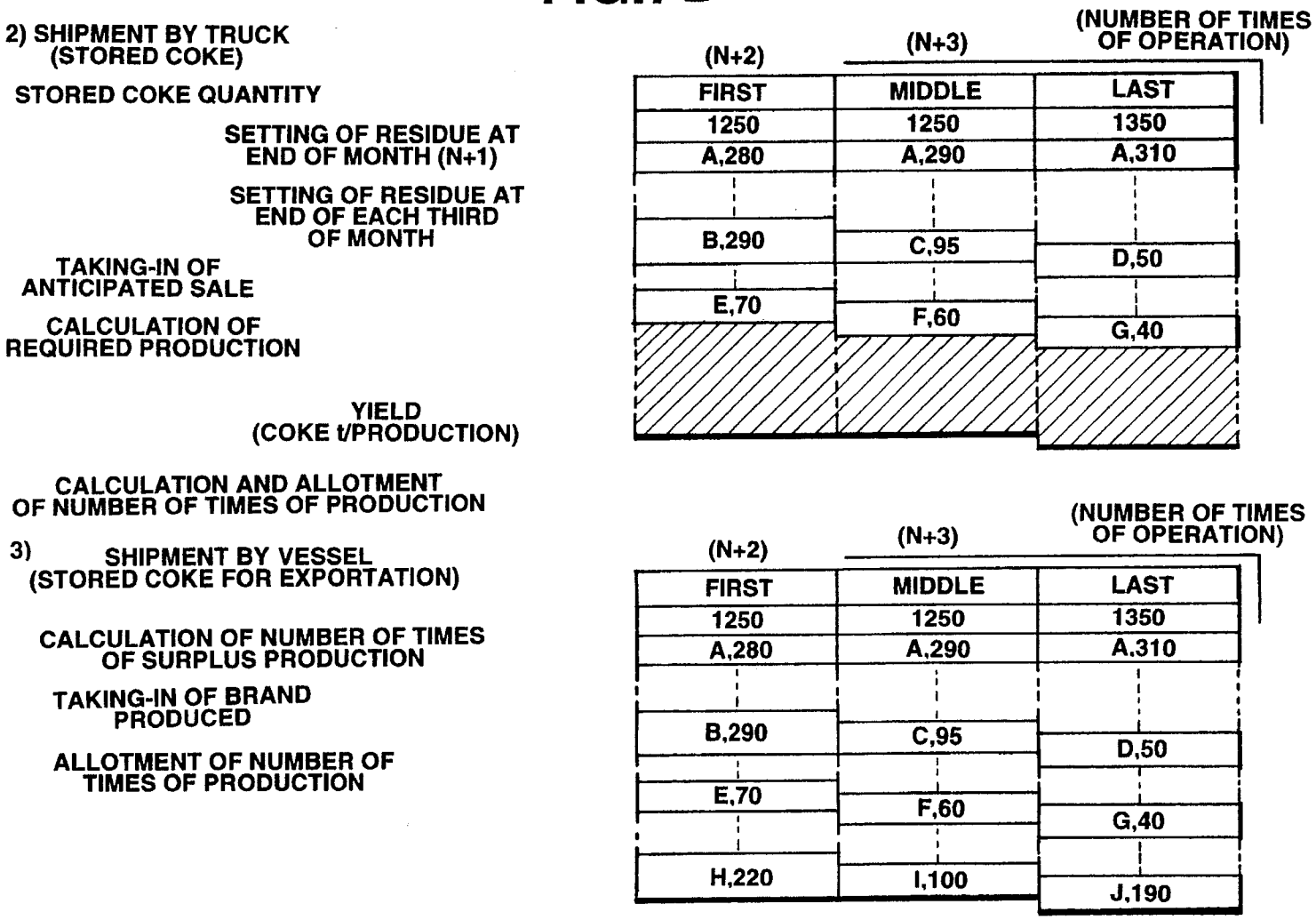

First, preparation of the large-scale scheduling 201 will be described with reference to FIGS. 6 and 7.

The large-scale scheduling 201 is prepared, for example, one time at the end of each month in order to manage balance in quantity between the stock coal and the coke product for every third of each month or for every month. The large-scale scheduling is a future two- or three-month schedule extending from receiving of the stock coal to production and shipment of the coke product which is prepared based on shipment information and anticipated shipment information of the coke product of each brand with respect to users 101 including both domestic and foreign users or the sales information 102, 102*a* stored in the head office 11 and branch offices 11*a* and information on receiving of the stock coal of each kind from the collieries 111 including foreign collieries or the incoming information of the stock coal. Then, the large-scale scheduling is input to the computer H, which carries out totalization, analysis and operation required.

The large-scale scheduling is mainly required for considering purchase of imported stock coal, and receiving (storage) of coal and production (storage) of coke in a relatively large lot for sale of coke for exportation.

1. Shipment Schedule (1) Between the last third of each month and the end of the month, an estimated shipment quantity (the quantity of order of the coke product and the estimated quantity thereof) for every "customer to which the coke product is to be shipped", every "brand" and every "particle size" extending over future three months from a month (N+1) (next month) to a month (N+3) (next month but two) which is issued from the head office and branch offices is allotted. For the month (N+1), an estimated shipment quantity required for every day is allotted. For each of the months (N+2) and (N+3), an estimated shipment quantity required for every third of a month or for every month is allotted.

(2) Then, the estimated shipment quantities allotted each are totalized. In this instance, when results of the totalization are judged to cause a possibility of causing production and shipment of the coke product to be hindered due to imbalance in a coke product of a large lot, adjustment may be optionally carried out.

2. Production Schedule (1) The quantity of storage of the coke product is set at the end of each of months (N+1) to (N+3) for every "brand" and every "particle size" based on the shipment schedule described above. Actually, the quantity is set to be substantially constant except for a large lot for exportation or the like because it is required to ensure stability of shipment and a space for storage of the coke product is restricted. The storage quantity for a large lot should be considered.

(2) The quantity of storage of the coke product is set at the end of each third of each month for every "brand" and every "particle size" as in the item (1) of the production schedule described above.

(3) Each of required production quantities (T/each third of each month) and (T/each month) extending from the beginning of the month (N+1) to the end of the month (N+3) is calculated on the basis of a set value of each of the storage quantities and each of the estimated shipment quantities allotted by the production schedule described above.

(4) In connection with a production capability of each of the coke ovens in the coke production factory, operation efficiency of each coke oven group from the beginning of the month (N+1) to the end of the month (N+3) is set to determine the number of times of production in each coke oven group for every month and every third of the month and therefore a production framework of each coke oven group.

(5) The production quantities (T/each third of each month) and (T/each month) calculated in the above-described item (3) of the production schedule is converted into the number of times of production required (times/each third of each month) and (times/each month) in view of a production yield (T/times) for every "brand" and every "particle size", which is then allotted to the production framework determined in the item (4) of the production schedule.

3. Consumption Schedule (1) Between the last third of each month and the end of the month, the estimated quantity of receiving of the stock coal of each brand for future three months extending from the month (N+1) (next month) to the month (N+3) (next month but two) is input at every third of each month from the head office and, particularly, the estimated quantity for the month (N+1) is input every day.

(2) Monthly coal formulation is set on the basis of the estimated quantity of receiving of the stock coal defined in the above-described item (1) of the consumption, the residue of stored stock coal in the month N, and the production schedule for the months (N+1) to (N+3).

(3) The amount of consumption of stock coal for every brand is calculated on the basis of the monthly coal formulation set in the item (2) of the consumption schedule.

4. Receiving schedule (a) It is judged on the basis of the amount of consumption of the stock coal for every brand calculated in the item (3) of the consumption schedule whether the estimated quantity of stock coal to be received for every brand for future three months extending from the month (N+1) to the month (N+3) is appropriate. As a result, when it is not appropriate, a corrected receiving schedule (draft) is prepared.

(2) Correction is made on the basis of the receiving schedule (draft) prepared in the above-described item (1) of the receiving schedule, to thereby prepare a receiving schedule 51.

II. Preparation of Medium-Scale Scheduling

Figure 8:
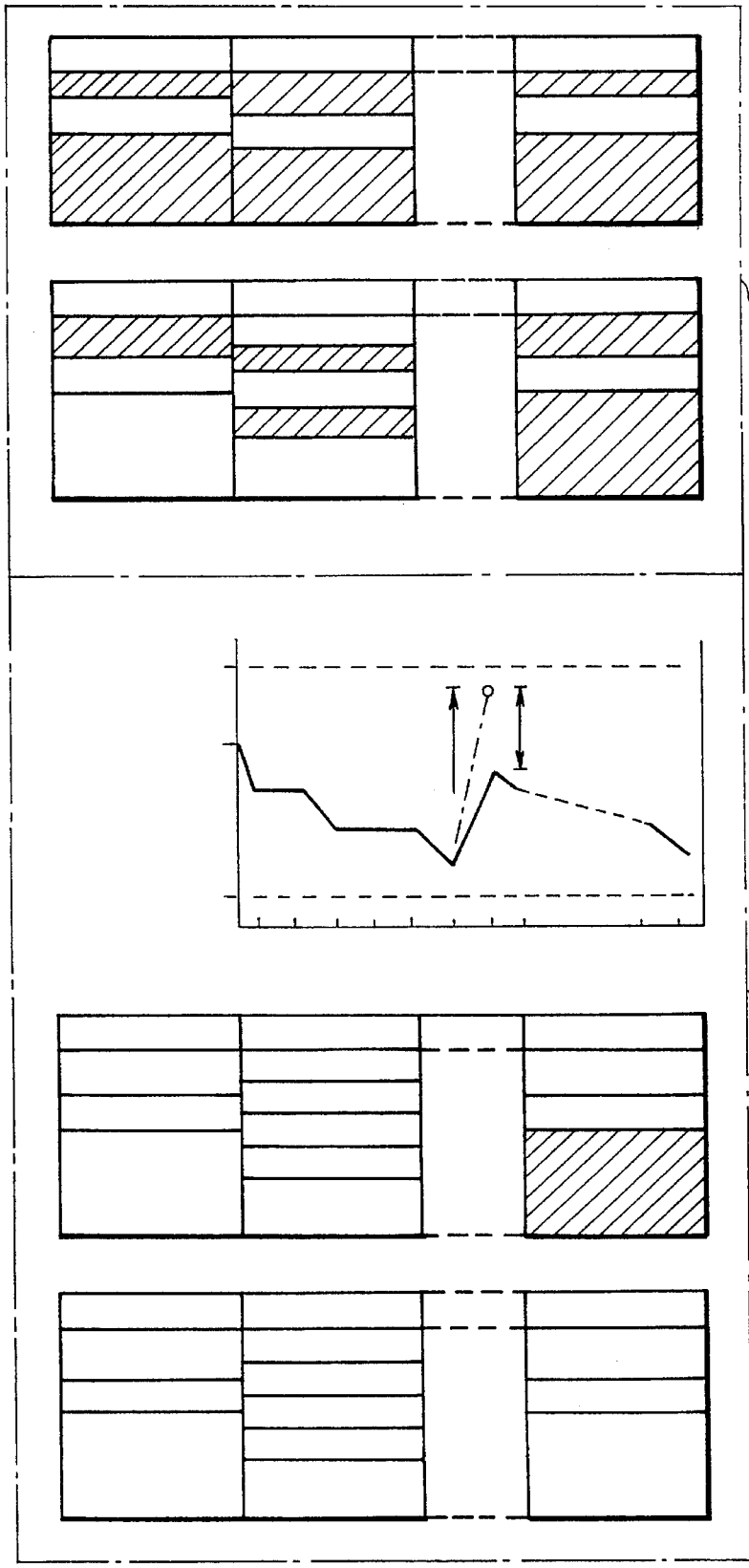
FIG. 8, 8*a*, 8*b* are schematic views showing an outline of preparation of each of medium-scale scheduling and small-scale scheduling in the operation management system of FIG. 1.
Figure 9:
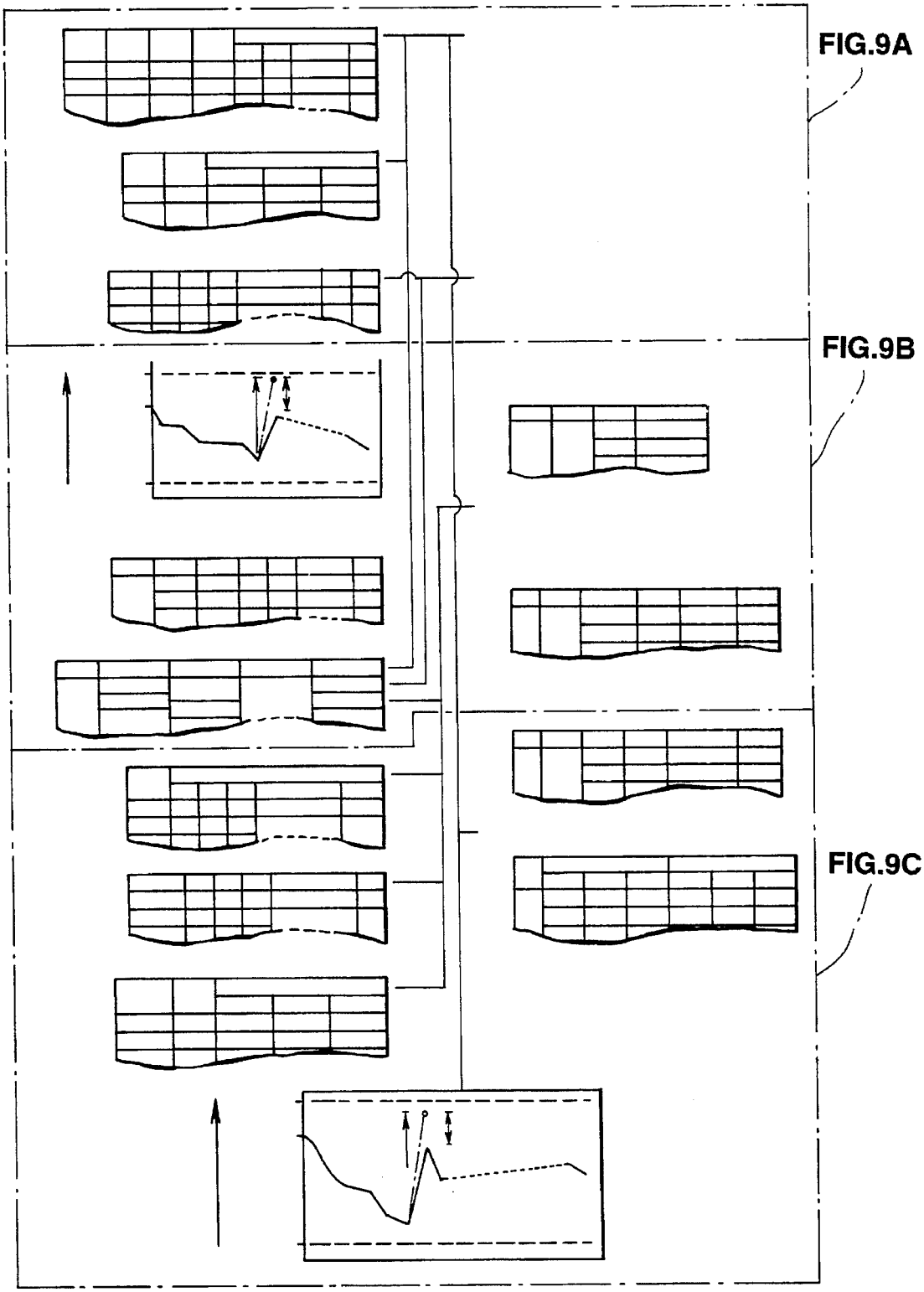
Figure 9A:
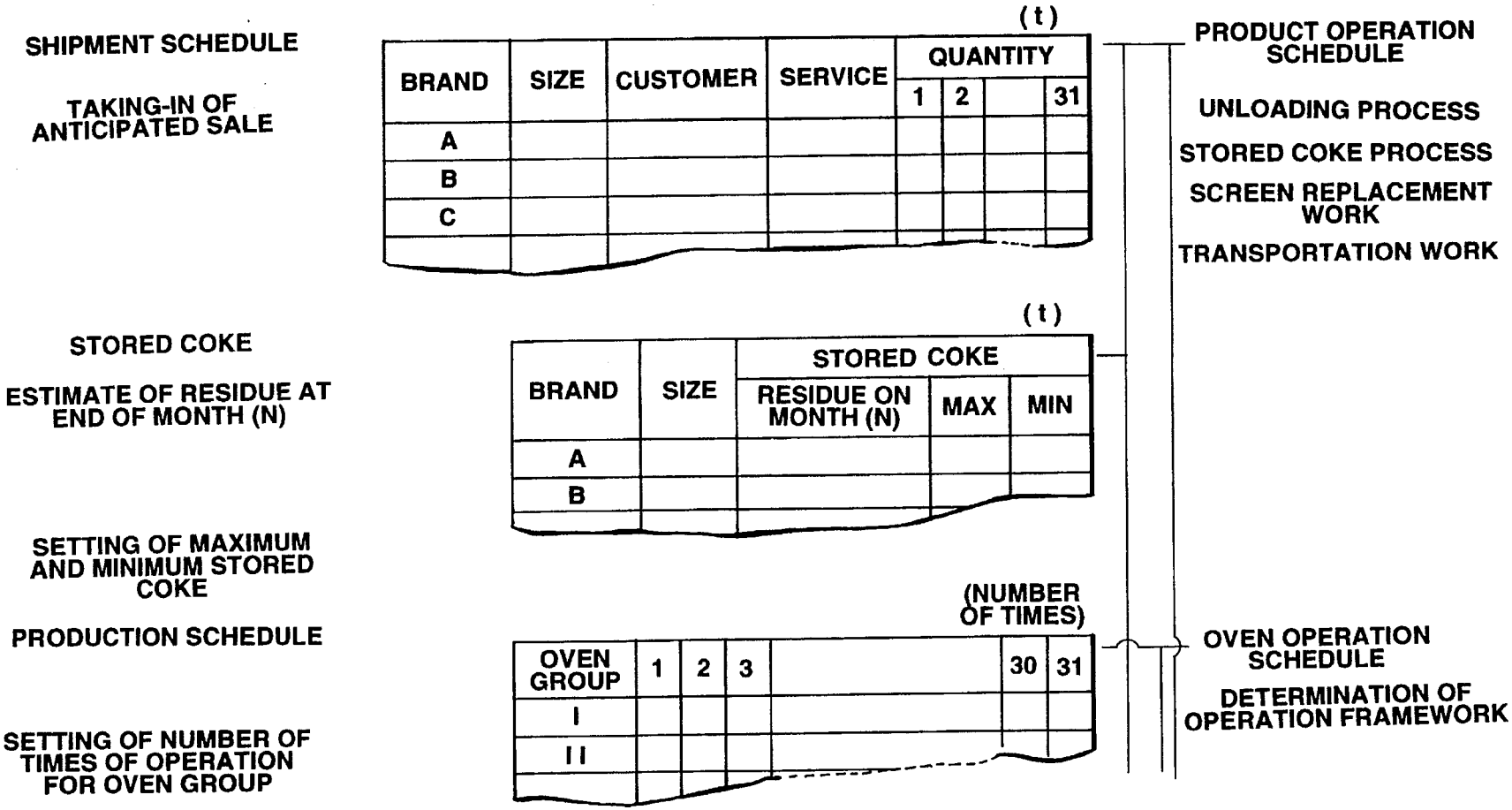
Figure 9B:
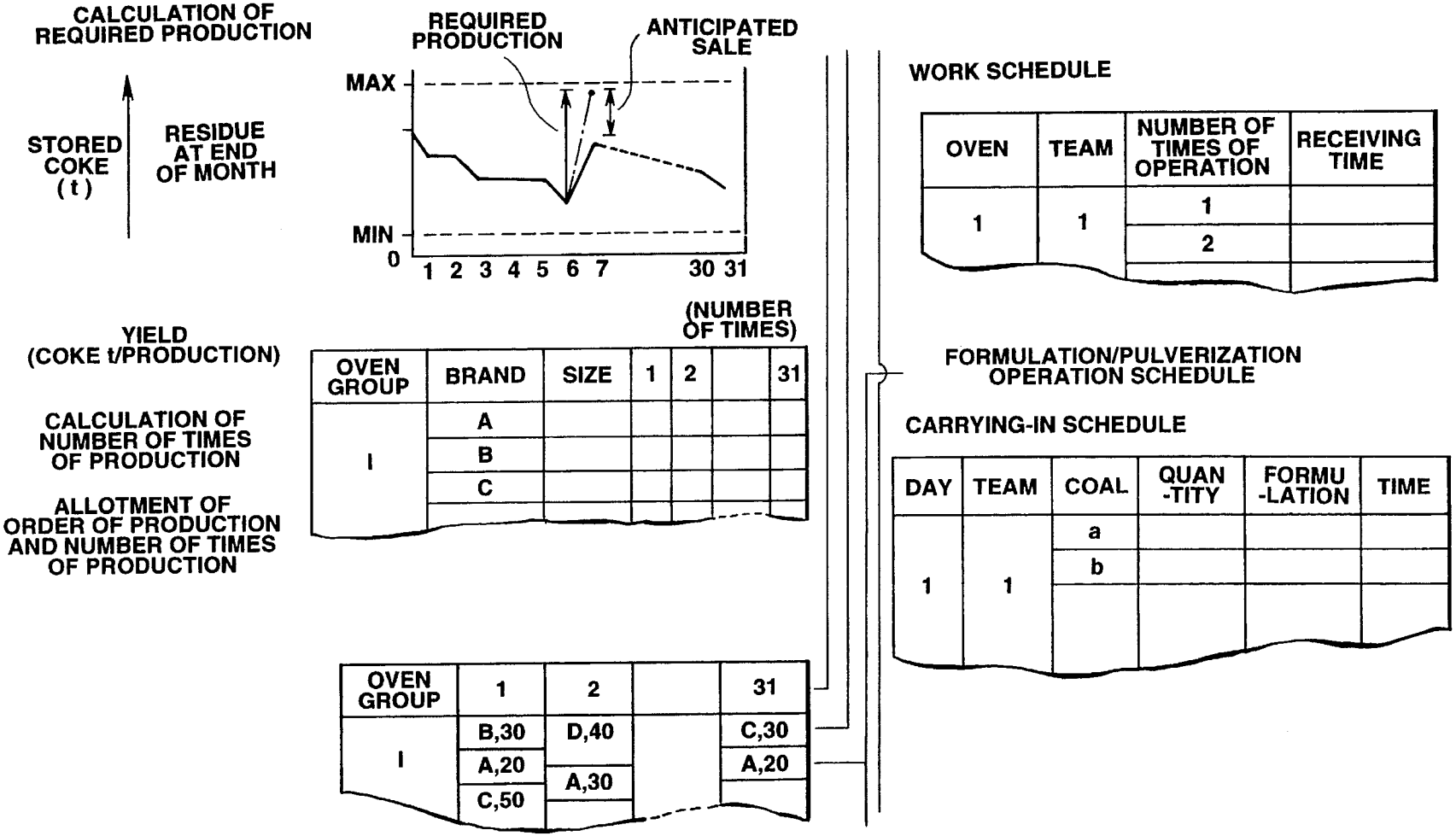

Now, preparation of the medium-scale scheduling 221 will be described hereinafter with reference to FIGS. 8 and 9.

The medium-scale scheduling 221 is prepared one time at the end of each month based on the incoming information 112 of the stock coal from the head office 11 and branch offices 11*a*, and the sales information 102 on shipment of the coke product and the sales information on estimated shipment of the coke product, to thereby make a plan on the operation for every day from the beginning of the next month to the end thereof. The medium-scale scheduling is input to the computer H like the large-scale scheduling described above, resulting in totalization, analysis and operation required being carried out.

1. Shipment Schedule (1) Between the last third of each month and the end of the month, estimated shipment quantities (the quantity of order of the coke product and the estimated quantity thereof) for every "customer to which the coke product is to be shipped", every "brand" and every "particle size" in the month (N+1) which are issued from the head office and branch offices are allotted.

(2) The estimated shipment quantity allotted is compared with an estimated shipment quantity finally determined. As a result, when any difference therebetween, correction is made.

2. Production Schedule (Oven Charge Schedule and Oven Discharge Schedule)

(1) In connection with a production capability of each of the coke ovens in the production factory in relation to the month (N+1), the number of times of production possible for every day (number of times/day) and therefore a production framework are set in view of operating efficiency of each of the coke ovens finally determined and a monthly operation schedule for every coke oven group.

(2) The estimated daily shipment quantity allotted in the above-described item (1) of the shipment schedule is converted into a production quantity (the number of times of production/day) in view of production yields (T/the number of times of production) for every "brand", every "particle size" and the like.

(3) In connection with the production framework set in the above item (1) of the production schedule, the number of times of production possible (the number of times of production/day) for every day for every coke oven group is allotted between the beginning of each month and the end thereof based on the shipment quantity for every day (the number of times of shipment) provided in the above item (2) of the production schedule, as follows:

More particularly, first, the preconditions therefor includes the following factors:

(i) Coke Oven Group and Production Brands:

First Coke Oven Group: α, β

Second Coke Oven group: α

Third Coke Oven Group: γ wherein α, β and γ each indicate a production brand used with respect to each of customers to which the coke product is shipped. A number of such production brands are set independently.

(ii) It is required not to cause stockout.

(iii) It is required to increase a scale of each production lot in order to decrease a cost for physical distribution and improve workability.

Now, an outline of the allotment will be described hereinafter. For example, the allotment in the first coke oven group may be carried out as follows:

(iv) A brand which is subject to shipment by a vessel (immediate shipment) is allotted on the assumption of shipment date=production date.

(v) A brand which is subject to shipment by a truck (stored coke) is allotted to a large scale and a small scale based on a production date and the number of lots in view of balance of the quantity of stored coke.

(vi) In connection with a brand which is subject to shipment by a vessel (stored coke, exported coke), the residual production framework is allotted to a shipment date of the month (first, middle and last thirds of the month) and a shipment date of the next month on.

Thus, the allotment is basically carried out in order of (iv), (v) and (vi). In this instance, the allotment is substantially subject to the following restrictions, (vii) Operation of replacement of a screen of the screen classifier:

The operation of replacement of the screen due to a difference in shipment brand and particle size should not be carried out, for example, at midnight.

(viii) COG occurrence balance

The amount of generation of gas is varied depending on a production brand, therefore, the amount of generation (feed) of COG gas within one day should be restricted to a predetermined limit (upper limit to lower limit)

3. Consumption Schedule (1) With respect to the daily production schedule prepared as described above, the quantity of daily consumption of the stock coal for every brand between the beginning of the month (N+1) and the end thereof is calculated by the monthly formulation of the stock coal set in the above-described large-scale scheduling.

(2) In connection with stock coal to be received from an ocean-going ship of which a receiving schedule is already determined, whether time at which the receiving is carried out is appropriate is confirmed on the basis of the consumption quantity defined in the item (1) of the consumption schedule.

4. Receiving Schedule (1) The quantity of receiving of stock coal per day for every brand is set on the basis of the quantity of consumption of stock coal per day for every brand calculated in the item (1) of the consumption schedule. In this instance, when stock coal is forwarded from any other factory, the quantity of receiving of stock coal per day thus set is previously provided to the factory and, as required, determined to be a forwarded coal schedule.

5. Production Operation Schedule (for Future About 5 to 10 Days)

(1) A time zone in which coke discharged from a coke oven (oven discharged coke) is treated is allotted on the basis of the above-described shipment schedule and production schedule (oven discharge schedule) and in view of a period of time during which the coke is stored in a wharf.

(2) Stored coke is allotted for every brand and every predetermined quantity with respect to the daily time zone, as follows:

When it is possible to treat the stored coke concurrent with the oven discharged coke, it is allotted to the oven discharge time zone.

When it is impossible to treat the stored coke concurrent with the oven discharged coke, it is allotted to a time zone other than the oven discharge time zone.

(3) The above items (1) and (2) are combined with each other to determine a time zone for replacement of the screen of the screen classifier.

6. Stock Coal Pulverization and Formulation Operation Schedule (for Future About 5 to 10 Days)

(1) A time zone in which stock coal is extracted for every brand from each of coal bins is calculated on the basis of the above-described production schedule (oven discharge schedule) and the quantity of next charging of stock coal for every brand to each of the coal bins is allotted at a predetermined time before the coal bin is emptied or the next extraction is started, resulting in a carrying schedule being prepared.

In this instance, a carrying-in schedule for allotting an order of brands of stock coal carried into the formulation tank from the coal yard, the quantity thereof and a time zone thereof based on the carrying and formulation schedule is required. Such a carrying-in schedule is prepared in the small-scale scheduling described hereinafter.

7. Stevedoring Operation Schedule (for Future About 5 to 10 Days)

(1) A framework of an operation time zone per day for every coal yard is set.

(2) Of data taken in the above-described shipment schedule, data corresponding to the shipment by shipping is allotted to a wharf corresponding thereto (brand, quantity, type of ship).

(3) The above-described receiving schedule (brand, quantity, type of ship, coal yard) is allotted to the daily time zone.

III. Preparation of Small-Scale Scheduling

Now, preparation of the small-scale scheduling 241 will be described hereinafter with reference to FIGS. 8 and 9.

The small-scale scheduling 241 is a schedule set for every future about 4 days for carrying out each of the actual operations based on the above-described medium-scale scheduling.

Therefore, in the small-scale scheduling, a shipment schedule, a production schedule, a consumption schedule, a receiving schedule, a production operation schedule, a pulverization/formulation operation schedule and a stevedoring schedule are prepared every day in view of actual result data obtained until the previous day and the latest information on preceding coke shipment and stock coal receiving.

1. Shipment Schedule

The shipment schedule is the same as that in the medium-scale scheduling described above.

2. Production Schedule

The production schedule is the same as that in the medium-scale scheduling described above.

3. Consumption Schedule (1) Formulation of stock coal of each brand is determined with reference to quality of already incoming stock coal, actual results of quality of a coke product previously produced and operation conditions for the coke ovens.

(2) The quantity of consumption of stock coal for every brand is calculated on the basis of the above-described production schedule and the above item (1) of the consumption schedule.

4. Receiving Schedule

The receiving schedule is the same as that in the medium-scale scheduling described above.

5. Product Operation Schedule

The product operation schedule is the same as that in the medium-scale scheduling described above except that it is set for every future about 4 days.

6. Coal Pulverization and Formulation Operation Schedule.

The coal pulverization and formulation operation schedule is set for every future about 4 days.

(1) A time zone in which stock coal is extracted for every brand from each of coal bins is calculated on the basis of the production schedule described above and the quantity of stock coal of each brand charged to each of the coal bins at the next time is allotted at a predetermined time before the coal bin is emptied or the next extraction is started.

(2) The delivery quantity of coal from each of simple-coal tanks is calculated from the formulation calculated in the above item (1) of the consumption schedule on the basis of the quantity of charging of stock coal allotted in the above item (1) of the coal pulverization and formulation operation schedule and then combined with the above items (1) and (2) of the coal pulverization and formulation operation schedule, resulting in a carrying schedule being prepared.

(3) An order of simple coals carried in the formulation tank from the coal yard, the quantity of each simple coal, a time zone in which the carrying-in of each simple coal is carried out, and the like are calculated on the basis of the thus-prepared carrying schedule and the above-described receiving schedule, resulting in a carrying-in schedule being provided. In connection with the receiving schedule, concurrence of operation between gantry cranes is particularly considered.

7. Stevedoring Schedule

The stevedoring schedule is the same as that in the medium-scale scheduling except that it is set for every future about 4 days.

Now, an embodiment of a coal formulation accuracy management system for managing accuracy of formulation of stock coal in the coke oven operation management of the present invention will be described hereinafter with reference to FIG. 10.

A coal particle size management system of the illustrated embodiment, as described above, is adapted to carry out unified control of formulation accuracy for every kind of pulverized stock coal in correspondence to an operation management system according to a distributed control system (DCS or DCS system) for a coke oven using a computer in the coke production site. For this purpose, the system is featured in that various means are employed for ensuring more effective practicing of the system.

More particularly, in accordance with instructions on daily pulverization and formulation of each kind of stock coal which are set by the DCS system, the stock coal is pulverized into a predetermined particle size by means of a coal pulverization means and then carried in each of formulation tanks of a formulation system for every pulverization, resulting in being subject to a formulation treatment. Then, the coal thus treated is carried to a coal bin tank by means of a carrying system, to thereby be charged in a coke oven. The formulation system is provided with a moisture or water measuring means for measuring a water content of the pulverized stock coal, so that water contained in the pulverized coal is measured for every pulverization. Results of the measurement are introduced into a process computer, which calculates a water content of stock coal to be formulated in real time, resulting in a formulation ratio being corrected.

Now, an embodiment of a coal formulation accuracy management system of the present invention for pulverized stock coal will be described hereinafter with reference to FIG. 10.

Figure 10:
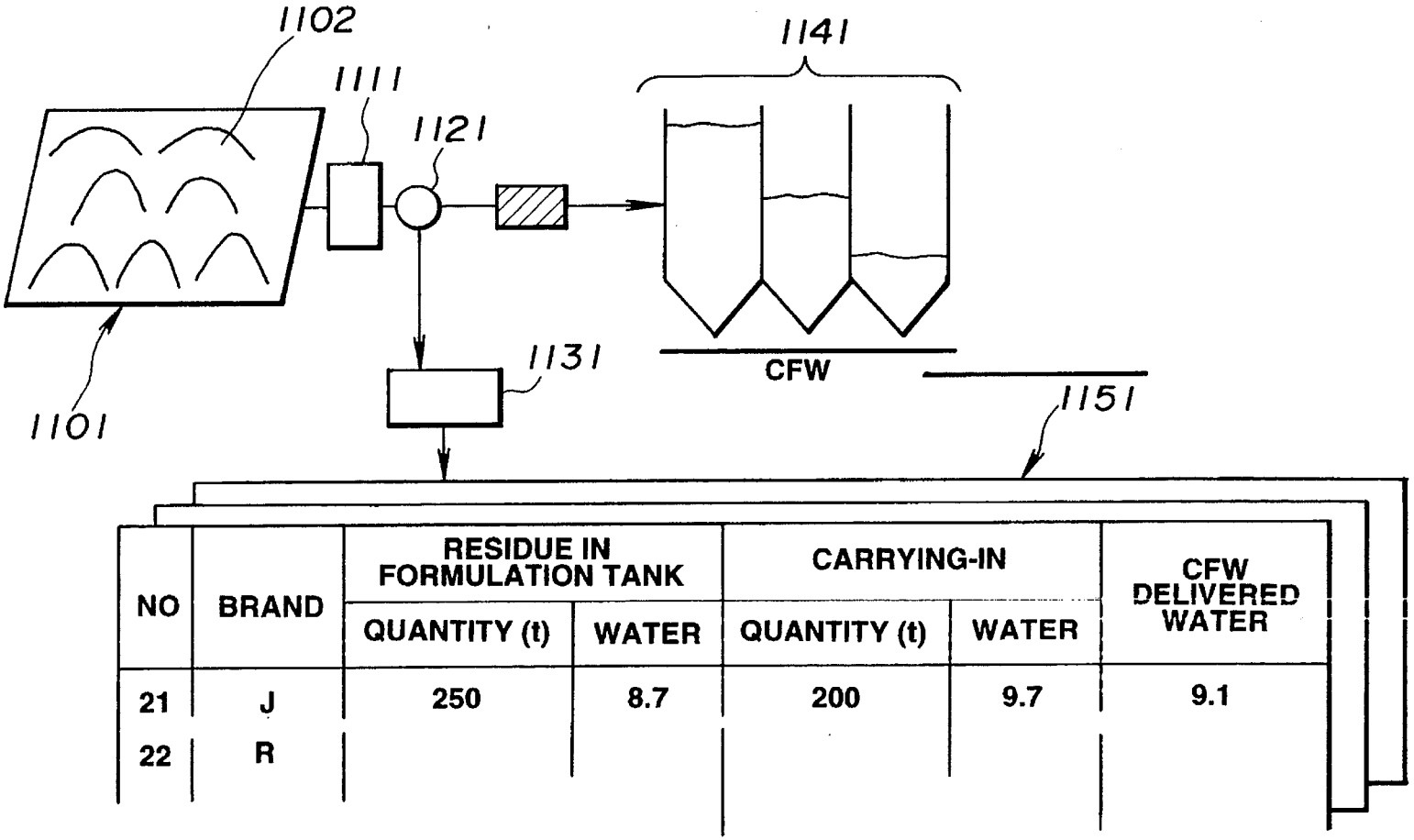
FIG. 10 is a schematic view showing an outline of pulverization and formulation of stock coal in the operation management system of FIG. 1.

FIG. 10 shows an outline of a formulation treatment for each kind of pulverized stock coal according to an embodiment of the present invention. More particularly, in FIG. 10, each kind of stock coal 1102 stored in a coal yard 1101 is pulverized into a predetermined particle size by means of a coal pulverizing machine constituting the carrying-in system or a coal pulverization means 111 such as an impeller breaker (IB) of which a pulverization slit width of pulverization blades is adjustably set or the like based on daily coal pulverization and formulation instructions for every brand from a daily coal pulverization and mixing information schedule 52. Then, the pulverized stock coal 1102 is sampled for particle size management for every pulverization. Also, a water content of the stock coal pulverized into the predetermined particle size is measured for every pulverization by means of a water measuring means 1131 provided in the formulation system. Results of the measurement are input to a process computer 1141.

Then, the stock coal which has been subject to water measurement is delivered to formulation tanks 1251 arranged separate from each other. The process computer 1141 calculates a water content of the stock coal formulated on the basis of water measurement data input thereto in real time. A value calculated by the process computer 1141 is used for correction of a formulation ratio with respect to the formulation tanks 1231 to approach the formulation ratio to a predetermined formulation design value as close as possible. Further, the measurement results are used to prepare a data table 1161. In addition, stock coal thus subjected to the formulation treatment is charged in each of the coke ovens (not shown) through the coal bin tanks by means of the carrying system, resulting in carbonization being carried out as desired. The data table prepared using the measurement results and the like permits unified management of formulation accuracy of the stock coal pulverized.

Now, an embodiment of a coal particle size management system in the coke oven operation management of the present invention will be described hereinafter with reference to FIG. 11.

A coal particle size management system of the illustrated embodiment, as described above, is adapted to carry out unified control of particle size of each kind of pulverized stock coal in correspondence to an operation management system according to a distributed control system (DCS or DCS system) for a coke oven using a computer in the coke production site. For this purpose, the system is featured in that various means are employed for ensuring more effective practicing of the system.

More particularly, in accordance with instructions on daily pulverization and formulation of each kind of stock coal which are set by the DCS system, stock coal is pulverized into a predetermined particle size by means of a coal pulverization means and then carried in each of formulation tanks of a formulation system for every pulverization, resulting in being subject to a formulation treatment. Then, the coal thus treated is carried to a coal bin tank by means of a carrying system, to thereby be charged in a coke oven. The carrying-in system is provided with a particle size measurement means for measuring a particle size of the stock coal pulverized, which carries out sampling of each kind of pulverized stock coal at every pulverization, to thereby measure a pulverization particle size of the pulverized coal. The carrying system is provided with a water and particle size measurement means for measuring a water content of stock coal formulated and a particle size thereof, so that a water content of stock coal formulated and a particle size thereof are measured. Analytical data on the particle size of the pulverized coal obtained in the carrying-in system and data on measurement of the water content and particle size obtained in the carrying system are input to the process computer, which automatically adjusts a pulverization slit width of the coal pulverization means depending on the data input thereto to constantly keep the pulverization particle size at a set value.

Now, an embodiment of a coal particle size management system according to a further embodiment of the present invention will be described hereinafter.

Figure 11:
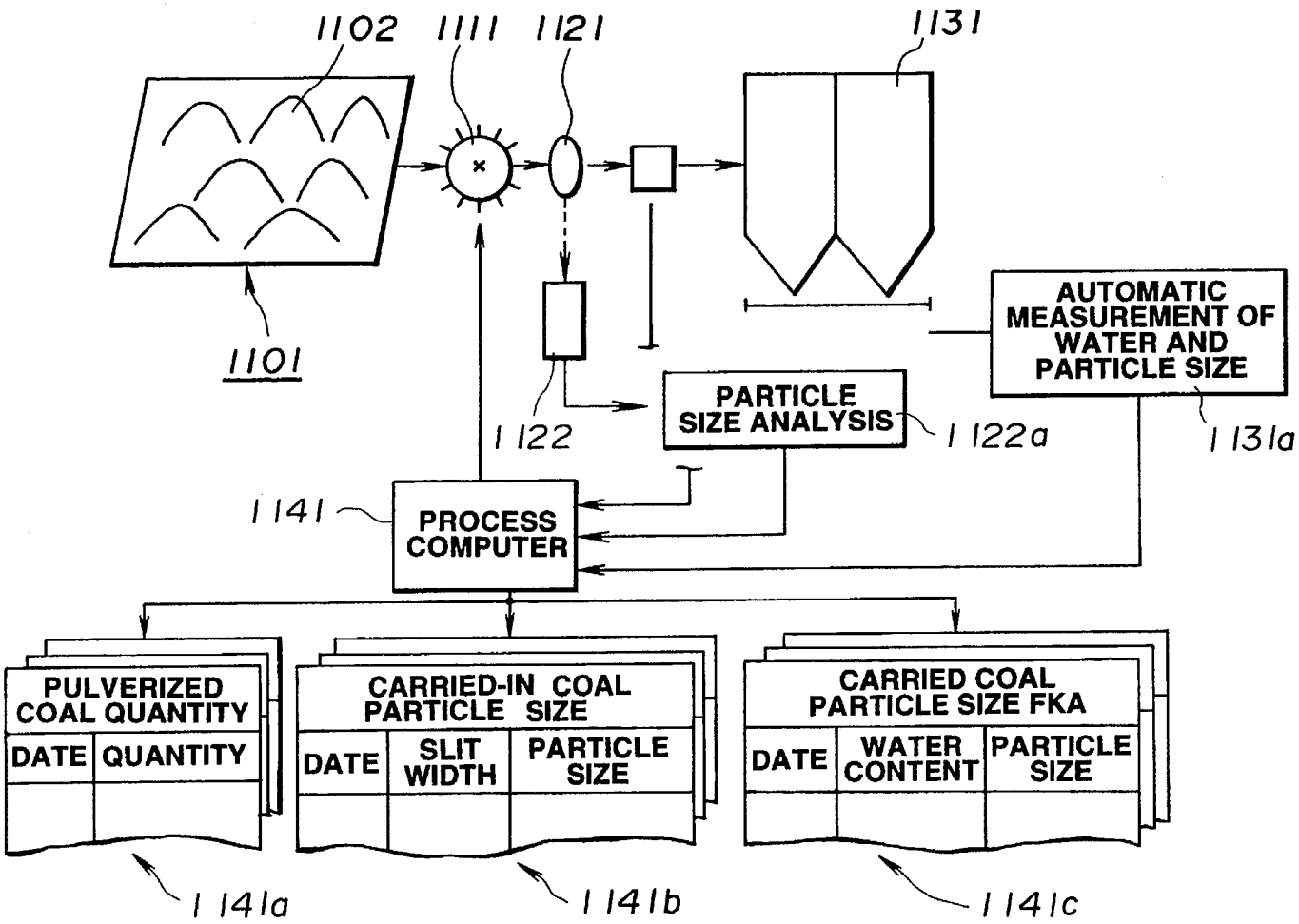
FIG. 11 is a schematic view showing an outline of pulverization and formulation of stock coal in the operation management system of FIG. 1.

FIG. 11 shows an outline of a pulverization and formulation treatment for each kind of stock coal according to an embodiment of the present invention. More particularly, in FIG. 11, each kind of stock coal 1102 stored in the coal yard 1101 is pulverized into a predetermined particle size by means of the coal pulverizing machine constituting the carrying-in system or the impeller breaker (IB) 1111 of which a pulverization slit width of the pulverization blades is adjustably set based on the daily pulverization and mixing information schedule 52 for stock coal of each brand. Then, the pulverized stock coal 1102 is sampled for particle size management by means of an automatic sampler 1121 every time when the pulverization takes place, resulting in being subject to measurement of a pulverized particle size by means of a particle size measuring equipment 1122. Then, the stock coal thus pulverized into a predetermined particle size is carried in the formulation tank 1131 constituting the formulation system for a formulation treatment and then charged in each of the coke ovens (not shown) through the coal bin (CB) tank by means of the carrying system, resulting in being subject to a required carbonization treatment.

Data on results of particle size analysis **1122*a* by means of the particle size measuring equipment 1122 which is carried out during the above-described pulverization treatment and formulation treatment of each kind of stock coal are input to a process computer 1141. Also, the stock coal formulated in the carrying system is subject to automatic measurement 1131*a* for measuring an average water content thereof and an average particle size thereof. Water content and particle size data thus obtained are likewise into to the process computer 1141**.

Then, the process computer 1141 carries out operation of the analytical data and water content/particle size data to estimate a degree of wear of the pulverization blades of the impeller breaker 1111 to automatically adjust the pulverization slit width of the pulverization blade in correspondence to the wear, to thereby keep the slit width appropriate. Concurrently, a pulverization tale **1141*a* for indicating the quantity of pulverization of the pulverized stock coal, a carrying-in particle size table thereof and carrying table 1141*c*** thereof are prepared, resulting in unified control of results of the pulverization particle size being possible.

Now, an embodiment of a coke particle size management system in production of a coke product according to the present invention will be describe hereinafter with reference to FIG. 12.

Figure 12:
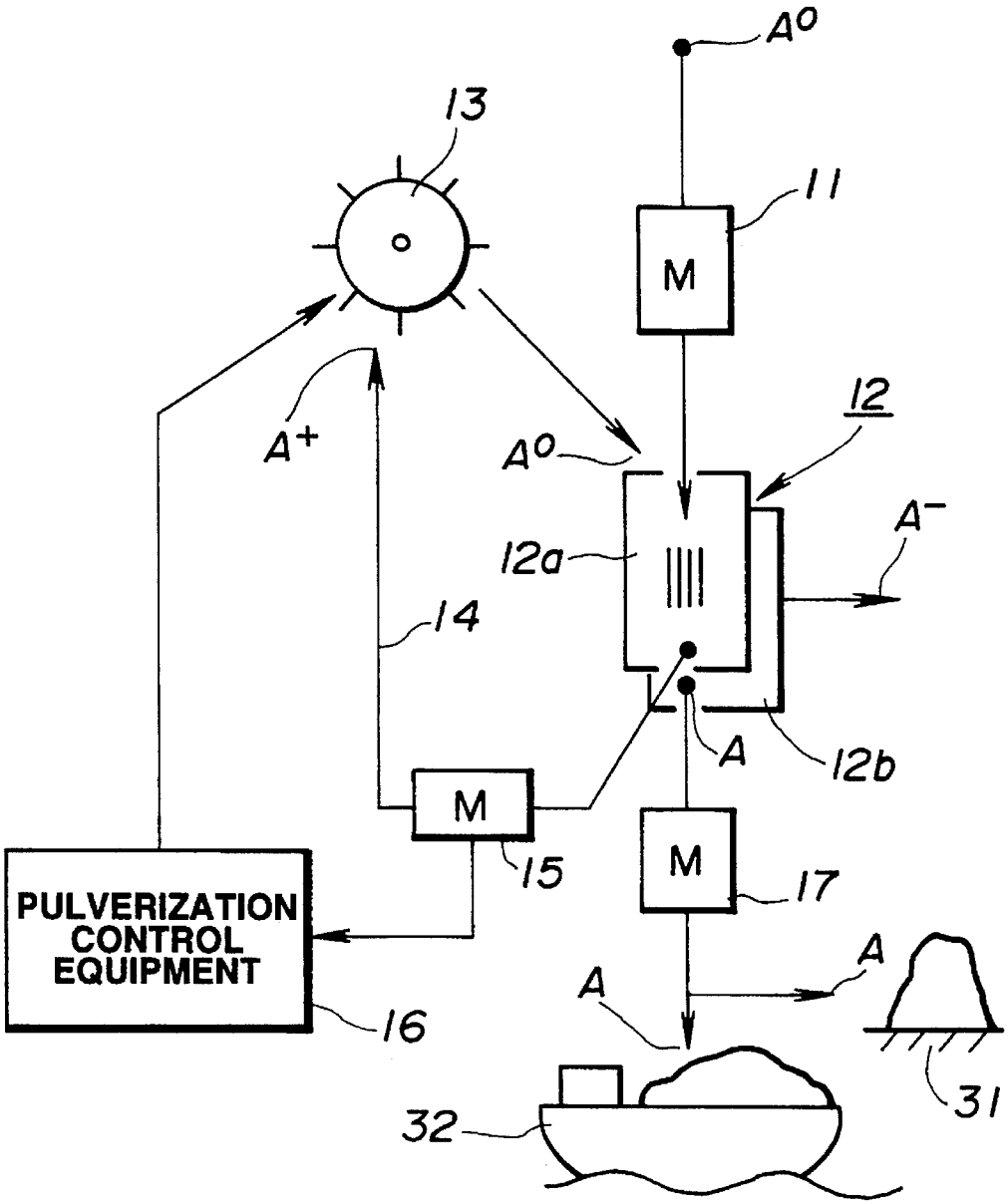
FIG. 12 is a schematic view showing an outline of a coke particle size management system by pulverization and grading according to another embodiment of the present invention.
Figure 13A:
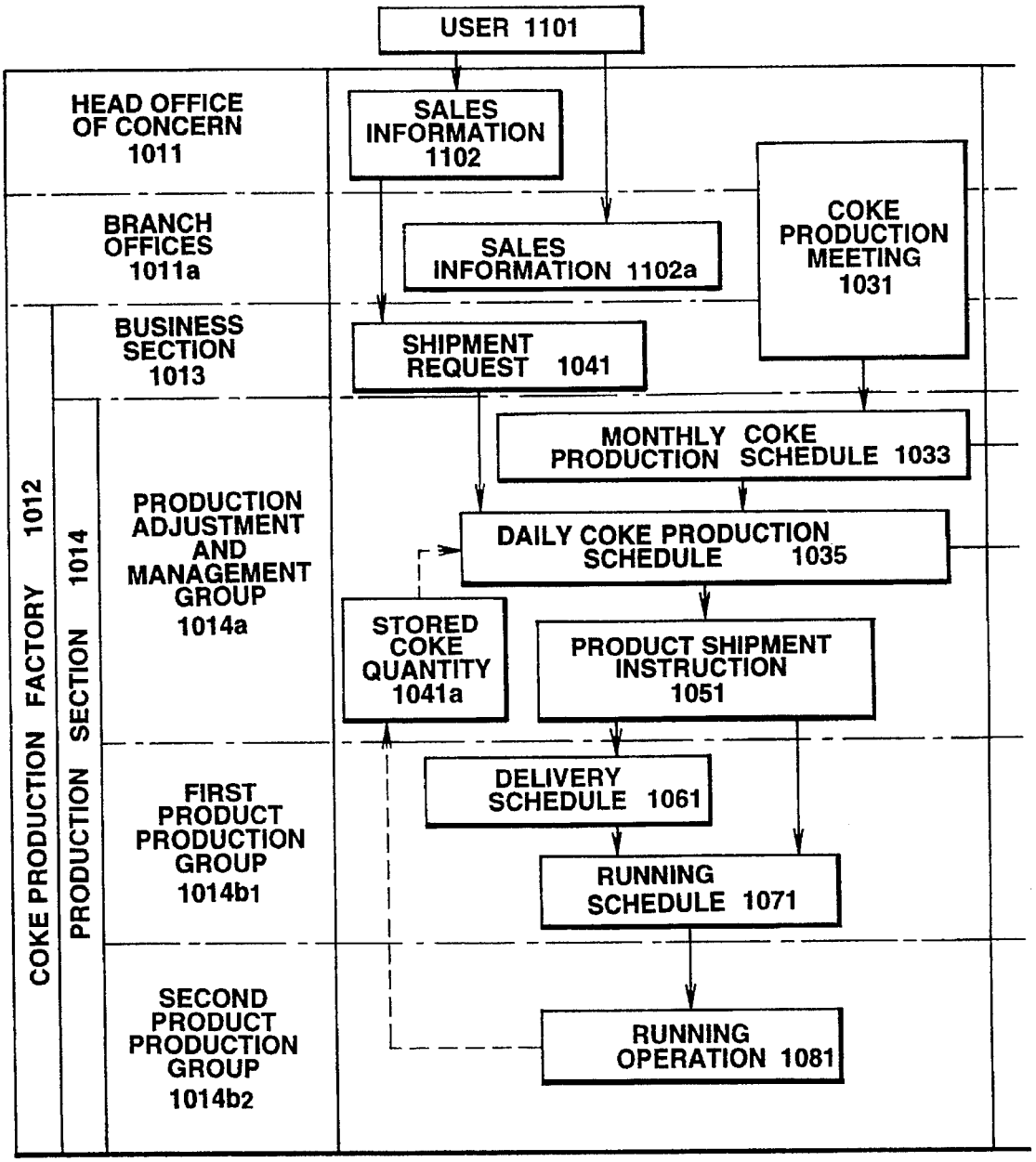
FIG.13A PRIOR ART
FIGS. 13A and 13B illustrate a flow chart showing a conventional operation management system for a coke oven.
Figure 13B:
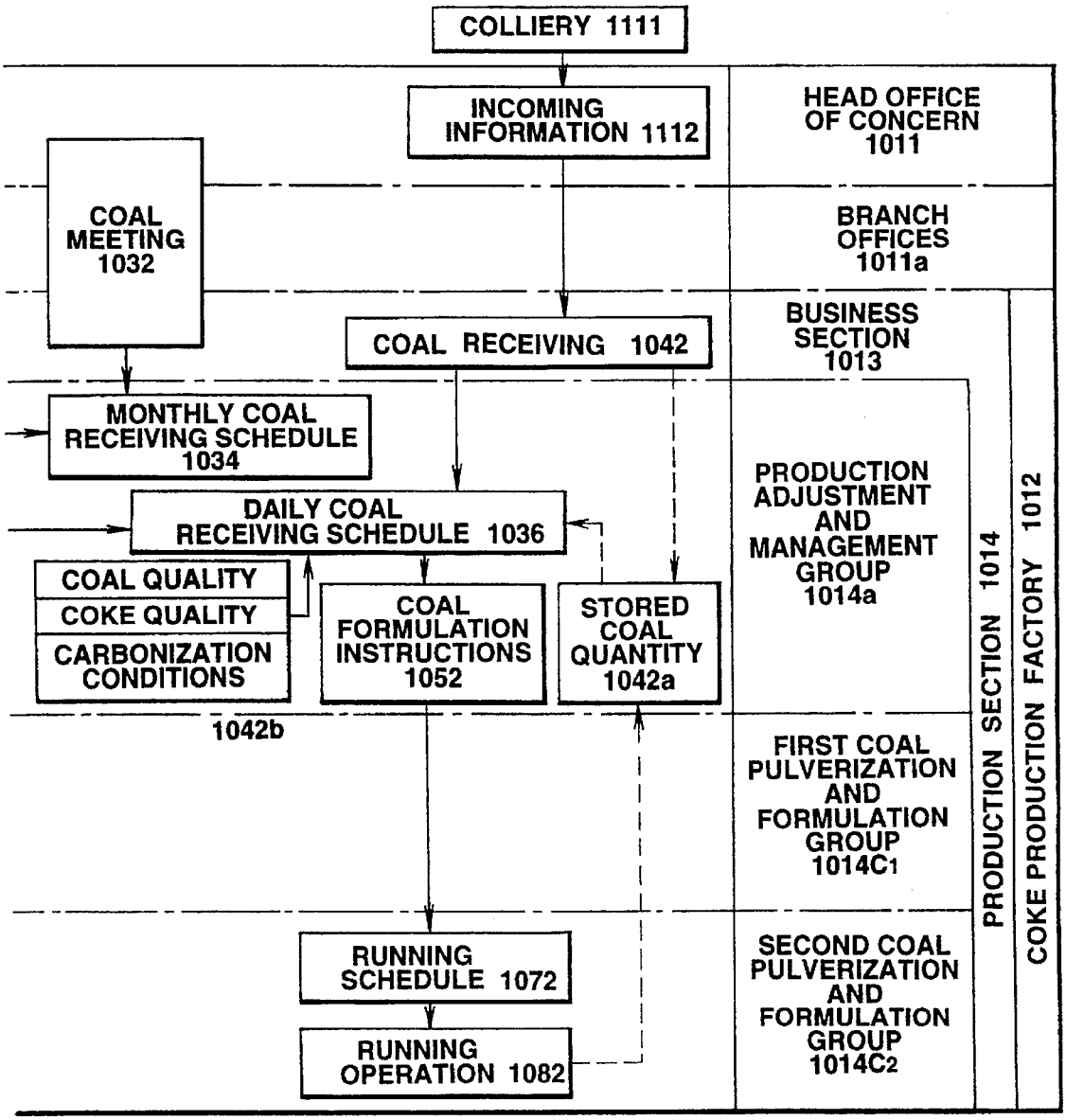
FIG.13B PRIOR ART
Figure 14:
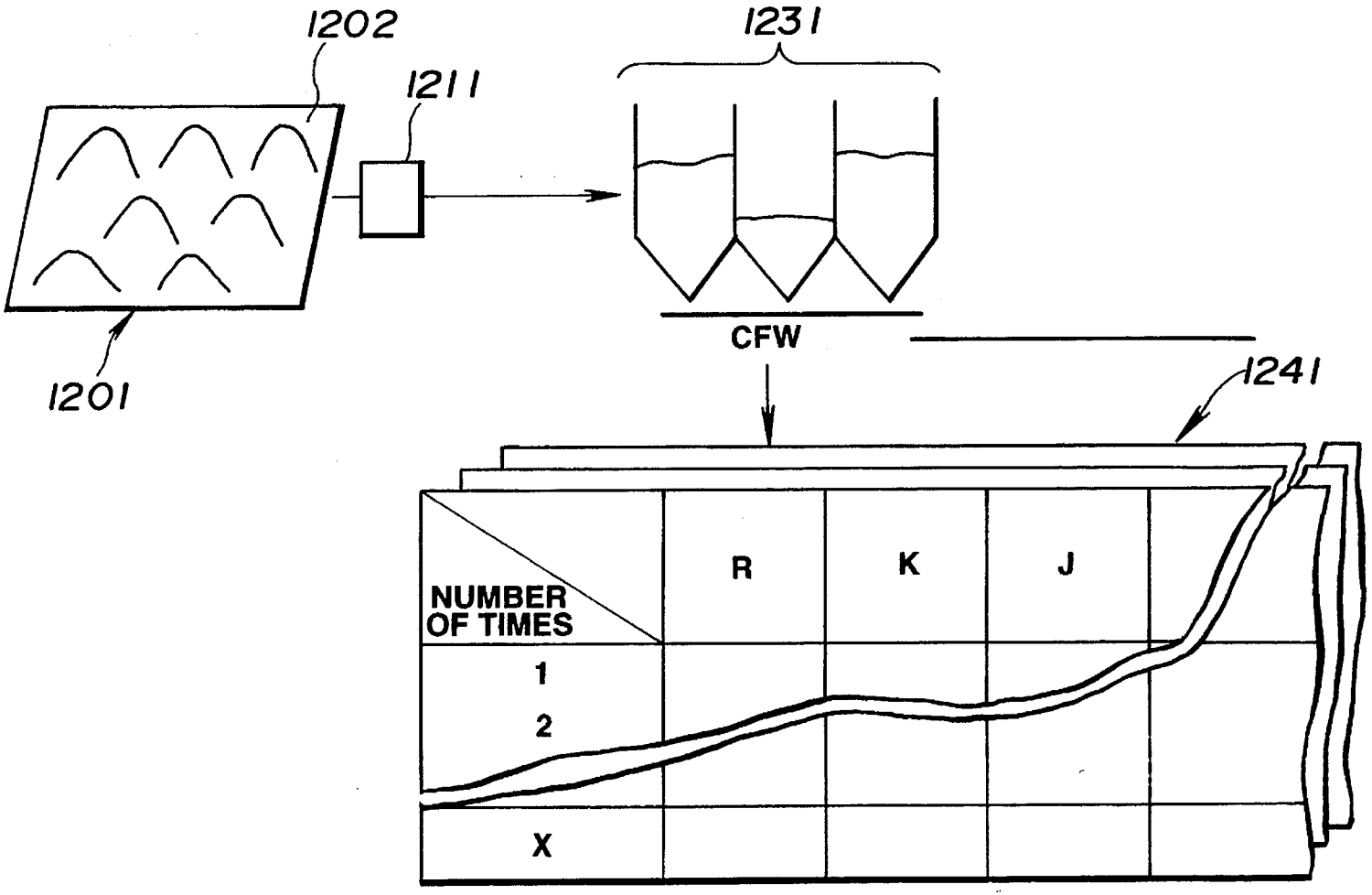
FIG.14 PRIOR ART
FIG. 14 is a schematic view showing an outline of pulverization and formulation of stock coal in the conventional operation management system of FIG. 13.
Figure 15:
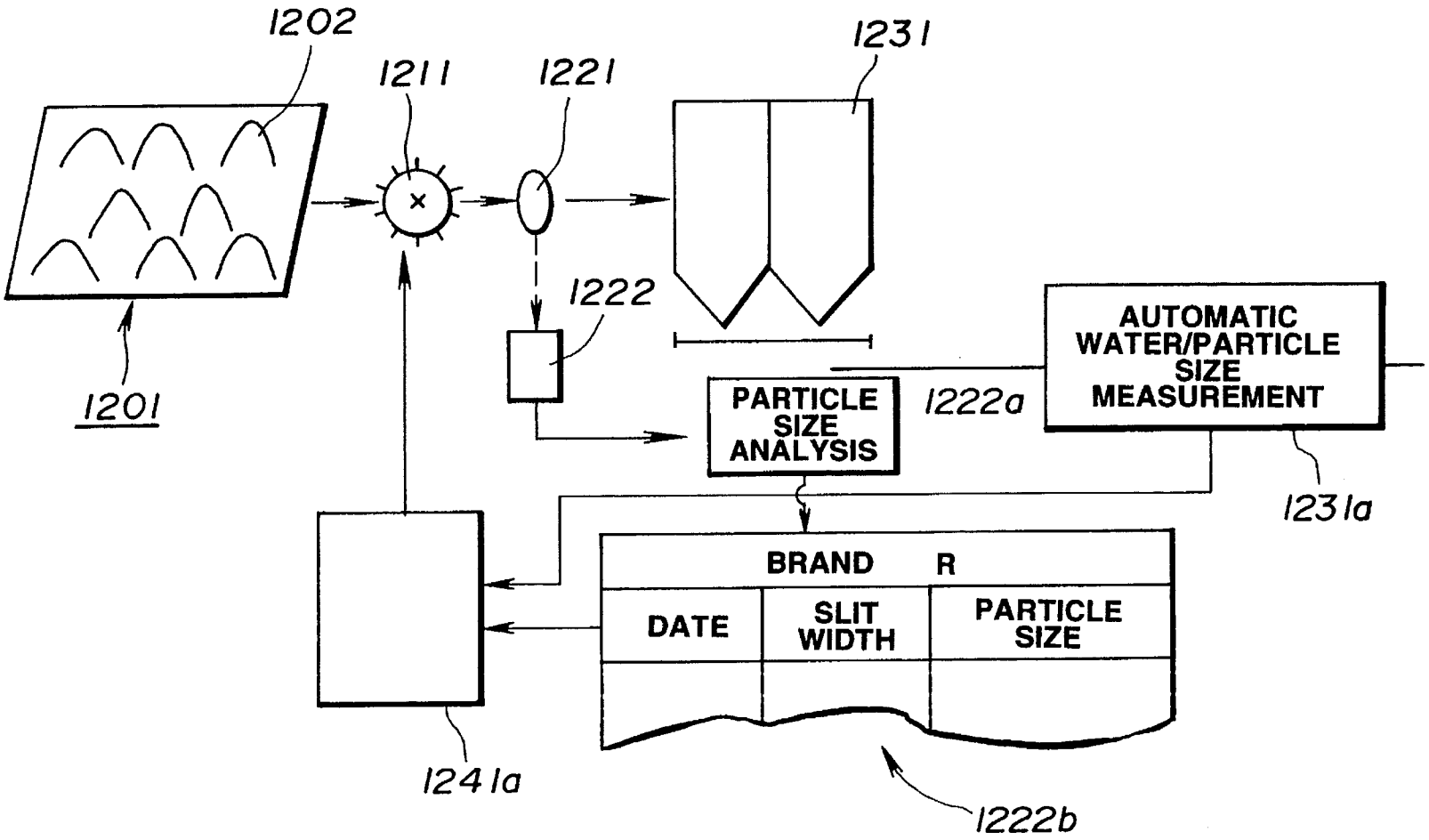
FIG.15 PRIOR ART
FIG. 15 is a schematic view showing an outline of pulverization and formulation of stock coal in the conventional operation management system of FIG. 13.

FIG. 12 schematically shows a particle size management system for a coke product by a pulverization and grading treatment of a carbonized coke to which an embodiment of the present invention is applied. More particularly, the coke particle size management system of the illustrated embodiment includes a first weighing equipment 11 for weighing carbonized coke (crude coke) A° which has been unloaded from a coke oven after carbonization and subject to a quenching treatment and a screen classifier 12 for screening each of the weighed carbonized coke A° described above and pulverized carbonized coke A° described below to carry out grading of the coke. The screen classifier 12 includes a plurality of screens for screening the carbonized coke A over a predetermined multi-stage particle size range in the same manner as the prior art described above. More particularly, the screen classifier 12 includes a first screen 12*a* of a predetermined mesh arranged on an upper side for leaving carbonized coke $A^+$ of a particle size above a predetermined particle size range thereon and passing carbonized coke A of a particle size within the predetermined particle size range and carbonized coke $A^-$ of a particle size below the range therethrough and a second screen 12*b* of another predetermined mesh arranged on a lower side for leaving the carbonized coke A thereon and pass the carbonized coke $A^-$ therethrough.

Reference numeral 13 designates a pulverization equipment for pulverizing the carbonized coke $A^+$ left on the first screen 12*a* of the screen classifier 12. The coke $A^+$ is fed through a pulverization feed system 14 such as a belt conveyor to the pulverization equipment 13. The pulverization feed system 14 is provided with a second weighing equipment 15 for constantly weighing the carbonized coke $A^+$ fed by reflux to successively measure the quantity of the coke fed by reflux, to thereby output coke reflux data. Reference numeral 16 is a pulverization control unit for automatically adjusting pulverization performance of the pulverization equipment 13 such as, for example, a rotational speed of the pulverization equipment 13 depending on the coke reflux data. The coke pulverized by the pulverization equipment 13 is then fed to the first screen 12*a*.

The particle size management system of the illustrated embodiment further includes a third weighing equipment 17 for weighing the carbonized coke A left on the second screen 12*b* of the screen classifier 12 and a coke product B which has been subject to predetermined grading and therefore desired particle size management. The coke product B is thus weighed through the third weighing equipment 17, followed by shipment.

In the pulverization and grading system of the illustrated embodiment constructed as described above, the carbonized coke A° which is subject to carbonization for every formulation lot, unloaded from the coke oven and then subject to quenching is weighed through the first weighing equipment 11 in turn and continuously fed to the screen classifier 12, resulting in being classified.

More particularly, in the screen classifier 12, the carbonized coke A° fed through the first weighing equipment 11 thereto is subject to a screening treatment through the first screen 12*a* on the upper side, so that the carbonized coke $A^+$ over the predetermined particle size range is left on the screen 12*a* and the carbonized coke A within the range and the carbonized coke $A^-$ are passed therethrough. Subsequently, the carbonized coke A and carbonized coke $A^-$ passing through the first screen 12*a* are fed to the second screen 12*b* on the lower side, so that the carbonized coke A within the predetermined range is left thereon and the carbonized coke $A^-$ is passed therethrough.

Then, the carbonized coke $A^+$ above the predetermined particle size range which is left on the first screen 12*a* is fed to the pulverization equipment 13 through the pulverization feed system 14 by reflux in order, during which the quantity of coke momently varied with time is measured through the second weighing equipment 15, resulting in the coke reflux data being output from the second weighing equipment 13 to the pulverization control unit 16, which automatically adjusts pulverization performance of the pulverization equipment 13 such as, for example, a rotational speed of the pulverization equipment 13 depending on the coke reflux data while following the coke reflux quantity varied with time, so that the carbonized coke $A^+$ is pulverized through the pulverization equipment 13. The coke thus pulverized by the pulverization equipment 13 is then fed to the first screen 12*a*, followed by repeating of the above-described procedure. Thus, the illustrated embodiment is constructed so as to adjust pulverization performance of the pulverization equipment 13 depending on and following a variation in quantity of the carbonated coke $A^+$ passing through the third weighing equipment 17. Such construction permits the carbonized coke $A^+$ to be pulverized into a desired particle size, resulting in the particle size management being effectively accomplished. The above-described pulverization procedure is repeated until the carbonized coke $A^+$ above the predetermined particle size range is pulverized into a particle size within the range.

Figure 16:
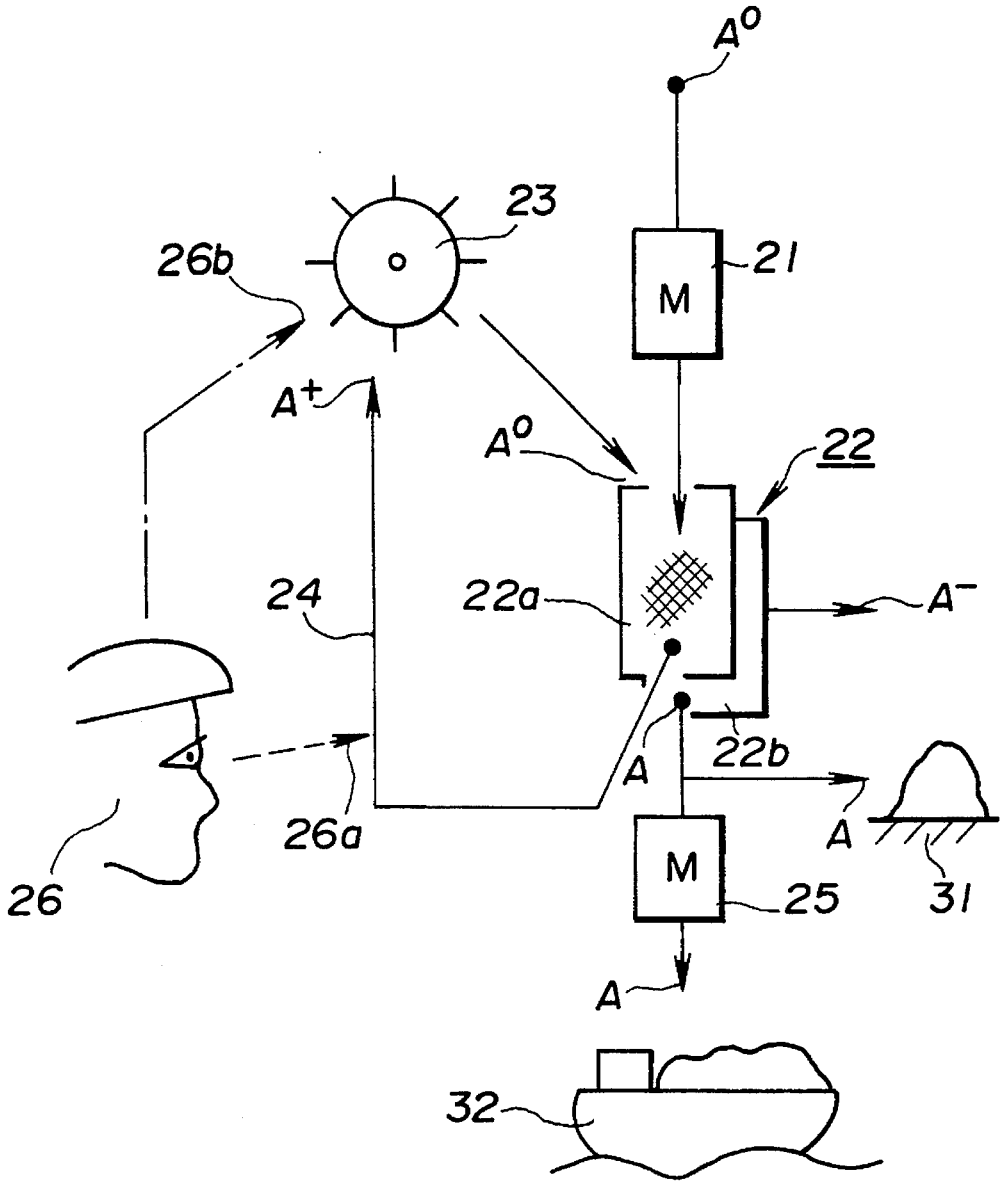
FIG.16 PRIOR ART
FIG. 16 is a schematic view showing an outline of a conventional coke particle size management system by pulverization and grading of carbonated coke.

Also, the carbonized coke A left on the second screen 12*b* has a qualification for the coke product B of a required or desired particle size because it is within the predetermined particle size range. Therefore, it is fed to a coke yard 31 for shipment after the pulverization treatment. Alternatively, it may be fed directly to the third weighing equipment 17 for weighing, followed by shipment in a carrying vessel 32. Further, the carbonized coke $A^-$ including a relatively small amount of coke excessively pulverized by the pulverization equipment 13 is regarded to be a coke product $B^-$ failing to satisfy a predetermined standard, In the prior art described above with reference to FIG. 16, the operator 26 visually judges quantity of the carbonized coke $A^+$ flowing through the pulverization feed system 24, to thereby adjust a rotational speed of the pulverization equipment 23 manually or by hand 26*b*. On the contrary, in the pulverization and grading system of the illustrated embodiment, the quantity of carbonized coke $A^+$ above the predetermined particle size range which is fed through the pulverization feed system 14 to the pulverization equipment 13 is constantly measured through the second weighing equipment 15 on the way to the pulverization equipment 13, so that the pulverization unit 16 automatically adjusts a rotational speed of the pulverization equipment depending on a variation in quantity of the coke fed to the pulverization equipment 13. Thus, the illustrated embodiment effectively produces a coke product within a desired particle size range while minimizing excessive pulverization of coke during pulverization by the pulverization equipment 13.

As can be seen from the foregoing, in the coke oven operation management system of the present invention, the head office and branch offices determine basic schedules for production and shipment of coke and receiving of stock coal based on information on sale and self-consumption depending on a user's demand for coke and incoming information on stock coal from a colliery, for example, for every month and notify the production adjustment and management section of the coke production factory of the basic schedules, request the production adjustment and management section of shipment of coke based on the user's demand, and instruct the production adjustment and management section to receive stock coal.

Also, the production adjustment and management section of the coke production factory prepares a primary schedule for each of production and shipment of coke and receiving of stock coal for every predetermined months such as, for example, for every 1 to 3 months based on the notified basic schedules for the production and shipment of coke and receiving of stock coal and a secondary detailed schedule for production and shipment of coke and receiving of stock coal for every day day of the month concerned, carries out management of the quantity of coke already stored, and management of the quantity of stock coal already stored and the quantity of stock coal received for every day concerned, and carries out formulation design of stock coal in view of quality of stock coal, quality of coke, carbonization conditions and the like, and prepares a daily coke oven running schedule between the product production section in which pulverization and formulation of stock coal is carried out and the production adjustment and management section under the stored coke quantity management and a pulverization and formulation running schedule for pulverization and formulation of stock coal according to daily formulation instructions under the stored coal quantity management.

Then, the product production section executes a running operation for pulverization and formulation of stock coal according to the pulverization and formulation running schedule and charging the coke oven with stock coal pulverized and formulated by the running operation and executes a running operation of the coke oven to subject the charged stock coal to a carbonization treatment, to thereby produce coke. Further, the operations between the head and branch offices and the coke production factory and in the head and branch offices and coke production factory and the processes between the production adjustment and management section and the product production section and in the sections are managed and controlled by means of a computer. Thus, the present invention permits unified control of the operation extending from receiving of each kind of stock coke to production and shipment of each kind of product coke to be accomplished while ensuring consistency between the production plants, to thereby significantly improve productivity in coke production.

Also, the coke oven operation management system of the present invention includes the factory management computer arranged in the coke production factory affiliated with the concern, and the plant running management computer, the plant running monitoring and controlling computer and the coke oven control computer arranged in the production adjustment and management section of the coke production factory and the product production section thereof.

The factory management computer is used for carrying out management of the whole management control system based on operation management information on a request for shipment of a coke product of each kind and receiving of stock coal of each kind input thereto from the head office and branch offices.

The plant running management computer is used for controlling the whole coke production plant based on operation management information on a request for shipment of a coke product of each kind and receiving of stock coal of each kind transmitted from the factory management computer, operation management information prepared so as to meet predetermined requirements and input thereto from the production adjustment and management section through the factory management computer, information on receiving of each kind of stock coal prepared for every month and every day, information on pulverization and mixing of the coal, a schedule for production and shipment of a coke product of each kind, management of stored coke quantity, management of stored coal quantity and formulation design of the coal, and information on a product running schedule for every month and every day and a pulverization and formulation operation schedule which is input thereto from the product production section through the factory management computer.

The plant running monitoring and controlling computer is used for carrying out synthetic running monitoring and controlling of processing plants each arranged for storage and pulverization/formulation of each kind of stock coal, coke oven plants each arranged for carbonization of stock coal formulated and processing plants each arranged for pulverization/grading and storage of each kind of coke product based on instructions from the plant running management computer. The coke oven control computer is used for controlling each of coke ovens constituting a coke group based on instructions from the plant running management computer.

Thus, the present invention permits consistent control processing between the computers, so that unified control of production of the coke product may be effectively accomplished. This results in productivity in coke production being further improved.

Also, in the coal formulation accuracy management system of the present invention, the water content measuring means measures a water content of the pulverized stock coal prior to formulation of each brand of stock coal pulverized. Results of the measurement are then input to the process computer, resulting in a water content of stock coal to be formulated calculated in real time to correct a formulation ratio, so that formulation of stock coal may be accomplished at a desired formulation ratio. Therefore, the system of the present invention contributes to an improvement in quality of the coke product and accomplishes unified control of formulation accuracy of stock coal pulverized and therefore unified control of the operation from receiving of the stock coal to production and shipment of the coke product.

Further, in the coal particles size management system of the present invention, the particle size measuring means measures a particle size of pulverized stock coal. More particularly, the particle size measurement means suitably carries out sampling of the pulverized stock coal to analyze a particle size of the pulverized stock coal. The water and particle size measurement means measures a water content of the formulated stock coal and a particle size thereof. Data on the particle size of the pulverized coal and data on the water content and particle size of the formulated coal are input to the process computer, which carries out operation processing of the data to automatically adjust the pulverization slit width of the coal pulverization means. Thus, wear of the pulverization blades may be readily estimated to constantly keep the slit width of the pulverization blades sufficient to permit stock coal to be pulverized into a desired particle size, to thereby substantially eliminate a variation in particle size of pulverized coal depending on a brand of coal and the like. Thus, the present invention ensures unified management of a particle size of pulverized coal by means of the computer and therefore unified control of the operation from receiving of the stock coal to production and shipment of the coke product.

Moreover, the coke particle size management system of the present invention, as described above, includes the screen classifier for screening carbonized coke extracted for every formulation lot to subject it to grading. The screen classifier includes at least the first screen constructed for leaving carbonized coke above a predetermined particle size range thereon and passing carbonized coke within and below the predetermined particle size range therethrough and the second screen constructed for leaving the carbonized coke within the predetermined particle size range thereon and passing the carbonized coke below the predetermined particle size range therethrough. The carbonized coke above the predetermined particle size range left on the first screen is successively fed to the pulverization equipment for pulverization and then returned to the first screen for screening, followed by repeating the procedure to leave the carbonized coke within the predetermined particle size range on the second screen and the carbonized coke within the predetermined particle size range left on the second screen is extracted as a coke product graded. The system also includes the weighing equipment for measuring the quantity of carbonized coke above the predetermined particle size range fed from the first screen to the pulverization equipment in order and the pulverization control unit for controlling pulverization performance of the pulverization equipment depending on the quantity of carbonized coke successively measured by the weighing equipment.

Thus, in the coke particle size management system of the present invention, the carbonized coke above the predetermined particle size range left on the first screen is fed to the pulverization equipment by reflux for pulverization, during which the quantity of carbonized coke above the range fed to the pulverization equipment is successively measured, so that pulverization performance is adjusted depending on the quantity. Therefore, pulverization of carbonized coke by the pulverization equipment is satisfactorily executed while minimizing pulverization of coke into a particle size below the predetermined range.

What is claimed is:

1. A method of managing production of a coke oven, said method comprising the steps of:

a) determining basic schedules for production and shipment of coke and receiving of stock coal in accordance with a demand for coke;

b) notifying a production adjustment and management means of said basic schedules and requesting said production adjustment and management means to provide coke in accordance with said basic schedules;

c) instructing said production adjustment and management means to receive stock coal in accordance with said basic schedules;

d) preparing a primary schedule for production and shipment of coke and a primary schedule for receiving of stock coal in accordance with said basic schedules for production and shipment of coke and receiving of stock coal; respectively, every first predetermined period of time;

e) preparing a secondary schedule for production and shipment of coke and receiving of stock coal every second predetermined period of time shorter than said first predetermined period of time;

f) managing a quantity of stored coke and stored stock coal and a quantity of stock coal received every said second predetermined period of time;

g) carrying out a formulation design of said stock coal in accordance with said quantity of said stock coal, a quantity of said coke, and carbonization conditions;

h) preparing a coke oven running schedule between a product production means in which pulverization and formulation of stock coal is carried out, and said production adjustment and management means;

i) preparing a pulverization and formulation running schedule for pulverization and formulation of stock coal in accordance with formulation instructions;

j) executing a running operation for pulverization and formulation of said stock coal in accordance with said pulverization and formulation running schedule, and charging said coke oven with stock coal pulverized and formulated by said running operation; and k) executing a running operation of said coke oven to subject stock coal charged in step (j) to a carbonization treatment, to thereby produce coke, wherein said steps (a)–(k) are controlled by a computer.

2. A unified operation management system for a coke production plant, comprising:

a plant running management computer for managing said coke production plant in accordance with operation management information including a request for shipment of coke and receiving of stock coal, an indication of predetermined requirements of coke and stock coal, information regarding pulverization and mixing of said stock coal, a schedule for production and shipment of coke, information regarding management of stored coke, information regarding management of stored stock coal and formulation design of said stock coal, and information regarding a product running schedule of a pulverization and formulation operation schedule;

a plant running monitoring and controlling computer for carrying out synthetic running monitoring and controlling of processing plants each arranged for storage, pulverization, and formulation of said stock coal, coke oven plants each arranged for carbonization of stock coal, and processing plants each arranged for pulverization, grading, and storage of coke in accordance with instructions output by said plant running management computer;

a coke oven control computer for controlling coke ovens in accordance with instructions output by said plant running management computer; and a factory management computer for managing operation of said plant running management computer, said plant running monitoring and controlling computer, and said coke oven control computer in accordance with operation management information regarding a request for shipment of coke and receiving of stock coal.

3. A unified operation management system for a coke production plant, comprising:

a plant running management computer for managing said coke production plant in accordance with operation management information including a request for shipment of coke and receiving of stock coal, an indication of predetermined requirements for coke and stock coal, information regarding pulverization and mixing of said stock coal, a schedule for production and shipment of coke, information regarding management of stored coke, information regarding management of stored stock coal and formulation design of said stock coal, and information regarding a product running schedule of a pulverization and formulation operation schedule;

a plant running monitoring and controlling computer for carrying out synthetic running monitoring and controlling of processing plants each arranged for storage, pulverization, and formulation of stock coal, coke oven plants each arranged for carbonization of stock coal, and processing plants each arranged for pulverization, grading, and storage of coke in accordance with instructions output by said plant running management computer;

a water and particle size management computer for monitoring a water content of pulverized and formulated stock coal and a particle size thereof in accordance with instructions from said plant running management computer;

a coke oven control computer for controlling coke ovens in accordance with instructions output by said plant running management computer; and a factory management computer for managing operation of said plant running management computer, said plant running monitoring and controlling computer, said water and particle size management computer, and said coke oven control computer in accordance with operation management information regarding a request for shipment of coke and receiving of stock coal.

4. A coal formulation accuracy management system comprising:

a pulverization carry-in system for directing pulverized stock coal to formulation tanks of a formulation system in accordance with pulverization and formulation instructions to subject said pulverized stock coal to formulation treatment;

a carrying system for transporting formulated stock coal to a coal bin tank to charge a coke oven with said formulated stock coal;

water content measuring means for measuring a water content of pulverized stock coal to provide water data; and a process computer for receiving said water data and correcting a formulation ratio of said pulverized stock coal in accordance therewith.

5. A coal particle size management system comprising:

coal pulverization means for pulverizing stock coal into a predetermined particle size via pulverization blades of which a pulverization slit width is adjustably defined;

particle size measurement means for measuring a particle size of said pulverized stock coal;

a coal pulverization carry-in system for directing pulverized stock coal to formulation tanks of a formulation system to subject said pulverized stock coal to a formulation treatment;

water and particle size measurement means for measuring water content of said formulated stock coal and a particle size thereof;

a carrying system for carrying formulated stock coal to a coal bin tank and charging a coke oven with said formulated stock coal; and a process computer for receiving data of said particle size of said pulverized stock coal from said particle size measurement means and data of said water content and particle size of said formulated stock coal from said water and particle size measurement means and automatically adjusting said pulverization slit width of said coal pulverization means to adjust a particle size of said pulverized stock coal to a desired set value.

6. A particle size management system comprising:

a screen classifier for screening carbonized coke, said screen classifier including at least a first screen designed for extracting carbonized coke above a predetermined particle size range and passing carbonized coke within and smaller than said predetermined particle size range therethrough, and a second screen for extracting carbonized coke within said predetermined particle size range and passing carbonized coke smaller than said predetermined particle size range therethrough;

pulverization means for pulverizing said carbonized coke above said predetermined particle size range extracted by said first screen and sending pulverized carbonized coke back to said first screen, until all of said carbonized coke is within said predetermined particle size range;

weighing means for measuring a quantity of carbonized coke above said predetermined particle size range which is pulverized by said pulverization means; and a pulverization control unit for controlling said pulverization means in accordance with said quantity of carbonized coke measured by said weighing means.

* * * * *